US011142425B2

(12) United States Patent
Uchibori

(10) Patent No.: US 11,142,425 B2
(45) Date of Patent: Oct. 12, 2021

(54) MEDIUM STACKING DEVICE, MEDIUM TREATMENT APPARATUS, AND METHOD OF CONTROLLING MEDIUM STACKING DEVICE

(71) Applicant: SEIKO EPSON CORPORATION, Tokyo (JP)

(72) Inventor: Kenji Uchibori, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 39 days.

(21) Appl. No.: 16/727,296

(22) Filed: Dec. 26, 2019

(65) Prior Publication Data

US 2020/0207567 A1 Jul. 2, 2020

(30) Foreign Application Priority Data

Dec. 27, 2018 (JP) ..... JP2018-244293

(51) Int. Cl.

| | |
|---|---|
| ***B65H 31/34*** | (2006.01) |
| ***B65H 31/30*** | (2006.01) |
| ***B65H 29/04*** | (2006.01) |
| ***B65H 31/36*** | (2006.01) |
| *B65H 37/04* | (2006.01) |

(52) U.S. Cl.

CPC ..... *B65H 31/3081* (2013.01); *B65H 29/041* (2013.01); *B65H 31/36* (2013.01); *B65H 31/30* (2013.01); *B65H 37/04* (2013.01); *B65H 2301/4213* (2013.01)

(58) Field of Classification Search

CPC ..... B65H 31/30; B65H 31/34; B65H 31/36; B65H 31/3081

USPC ..... 270/58.12, 58.17, 58.27

See application file for complete search history.

(56) References Cited

U.S. PATENT DOCUMENTS

| | | | | |
|---|---|---|---|---|
| 7,318,584 | B2 * | 1/2008 | Kato | B42C 1/125 270/58.08 |
| 7,413,181 | B2 * | 8/2008 | Iida | G03G 15/6552 270/37 |
| 8,162,306 | B2 * | 4/2012 | Suzuki | B65H 31/34 270/58.12 |

FOREIGN PATENT DOCUMENTS

| | | |
|---|---|---|
| JP | S62-244865 | 10/1987 |
| JP | 2003-192213 | 7/2003 |
| JP | 2009-263127 | 11/2009 |
| JP | 2016-124655 | 7/2016 |

* cited by examiner

*Primary Examiner* — Leslie A Nicholson, III
(74) *Attorney, Agent, or Firm* — Workman Nydegger

(57) ABSTRACT

A medium stacking device includes an intermediate stacker that receives a medium treated by a treatment portion, and a first alignment member as an example of a contact portion, that is configured to move between a first position for performing an alignment operation on the medium on the intermediate stacker, and a second position that is separated further from the leading edge of the medium than is the first position. Furthermore, the medium stacking device is provided with a stacking portion that stacks the medium discharged from the intermediate stacker. The medium discharged from the intermediate stacker is stacked on the stacking portion after a leading edge contacts the first alignment member positioned at the second position.

12 Claims, 20 Drawing Sheets

FIG. 14

TD1

| VARIOUS CONDITIONS | THRESHOLD VALUE | FORCED DEFORMATION AMOUNT OF TRANSPORT DIRECTION | | FORCED DEFORMATION AMOUNT OF WIDTH DIRECTION | |
|---|---|---|---|---|---|
| | | PREDETERMINED AMOUNT | LESS THAN PREDETERMINED AMOUNT | PREDETERMINED AMOUNT | LESS THAN PREDETERMINED AMOUNT |
| PRINT SURFACE | ONE-SIDE SURFACE | 1 | 0 | 1 | 0 |
| | BOTH-SIDES SURFACE (LARGE AMOUNT OF LIQUID ON BOTTOM SURFACE) | 1 | 0 | 1 | 0 |
| | BOTH-SIDES SURFACE (LARGE AMOUNT OF LIQUID ON TOP SURFACE) | 1 | 1 | 1 | 1 |
| PRINT AREA | a% OR MORE | 1 | 0 | 1 | 0 |
| | LESS THAN a% | 1 | 1 | 1 | 1 |
| PRINT Duty | b% OR MORE | 1 | 0 | 1 | 0 |
| | LESS THAN b% | 1 | 1 | 1 | 1 |
| MEDIUM SIZE | MORE THAN A4 | 1 | 1 | 1 | 1 |
| | A4 OR LESS | 1 | 0 | 1 | 0 |
| MEDIUM TYPE | NORMAL PAPER | 1 | 0 | 1 | 0 |
| | EXCEPT NORMAL PAPER | 1 | 1 | 1 | 1 |
| MEDIUM THICKNESS | t1 mm OR MORE | 1 | 1 | 1 | 1 |
| | LESS THAN t1 mm | 1 | 0 | 1 | 0 |
| FIBER DIRECTION | LONGITUDINAL DIRECTION | 1 | 0 | 1 | 1 |
| | SHORT DIRECTION | 1 | 1 | 1 | 0 |
| CURL AMOUNT | PREDETERMINED VALUE OR MORE | 1 | 0 | 1 | 0 |
| | LESS THAN PREDETERMINED VALUE | 1 | 1 | 1 | 1 |

FIG. 15

TD2

| VARIOUS CONDITIONS | THRESHOLD VALUE | WIDTH MOVEMENT OR ROTATION OF MEDIUM SUPPORT | | VERTICAL MOVEMENT MEDIUM SUPPORT PORTION | |
|---|---|---|---|---|---|
| | | PRESENCE | ABSENCE | PRESENCE | ABSENCE |
| PRINT SURFACE | ONE-SIDE SURFACE | 1 | 0 | 1 | 0 |
| | BOTH-SIDES SURFACE (LARGE AMOUNT OF LIQUID ON BOTTOM SURFACE) | 1 | 0 | 1 | 0 |
| | BOTH-SIDES SURFACE (LARGE AMOUNT OF LIQUID ON TOP SURFACE) | 1 | 1 | 1 | 1 |
| PRINT AREA | a% OR MORE | 1 | 0 | 1 | 0 |
| | LESS THAN a% | 1 | 1 | 1 | 1 |
| PRINT Duty | b% OR MORE | 1 | 0 | 1 | 0 |
| | LESS THAN b% | 1 | 1 | 1 | 1 |
| MEDIUM SIZE | MORE THAN A4 | 1 | 1 | 1 | 1 |
| | A4 OR LESS | 1 | 0 | 1 | 0 |
| MEDIUM TYPE | NORMAL PAPER | 1 | 0 | 1 | 0 |
| | EXCEPT NORMAL PAPER | 1 | 1 | 1 | 1 |
| MEDIUM THICKNESS | t1 mm OR MORE | 1 | 1 | 1 | 1 |
| | LESS THAN t1 mm | 1 | 0 | 1 | 0 |
| FIBER DIRECTION | LONGITUDINAL DIRECTION | 1 | 0 | 1 | 1 |
| | SHORT DIRECTION | 1 | 1 | 1 | 0 |
| CURL AMOUNT | PREDETERMINED VALUE OR MORE | 1 | 0 | 1 | 0 |
| | LESS THAN PREDETERMINED VALUE | 1 | 1 | 1 | 1 |

MEDIUM STACKING DEVICE, MEDIUM TREATMENT APPARATUS, AND METHOD OF CONTROLLING MEDIUM STACKING DEVICE

The present application is based on, and claims priority from JP Application Serial Number 2018-244293, filed Dec. 27, 2018, the disclosure of which is hereby incorporated by reference herein in its entirety.

BACKGROUND

1. Technical Field

The present disclosure relates to a medium stacking device that aligns a medium such as a stacked sheet, a medium treatment apparatus including a discharge mechanism that discharges the aligned medium to a stacking portion, and a method of controlling the medium stacking device.

2. Related Art

For example, as an example of this type of medium stacking device, JP-A-2009-263127 discloses a post-treatment apparatus that aligns sheets as an example of a medium discharged from an image forming apparatus. The post-treatment apparatus is provided with a sheet discharge roller that transports a sheet as an example of a medium discharged from the image forming apparatus and discharges and stacks the sheet on a tilted alignment tray, and a movable leading edge stopper for aligning the sheet in a transport direction by bringing a trailing edge of the sheet into contact with an abutment surface of a reference fence, after pressing a leading edge of the sheet discharged to the alignment tray.

However, in the post-treatment apparatus described in JP-A-2009-263127, although the medium such as a sheet can be aligned on the alignment tray, there is a possibility that alignment of the medium such as a sheet discharged from the alignment tray to a sheet discharge tray which is an example of a stacking portion by the sheet discharge roller may be deteriorated.

SUMMARY

According to an aspect of the present disclosure, there is provided a medium stacking device including an intermediate stacking portion that receives a medium treated by a treatment portion, a contact portion configured to move between a first position for performing an alignment operation on the medium on the intermediate stacking portion, and a second position that is separated further from a leading edge of the medium than is the first position, and a stacking portion that stacks the medium transported from the intermediate stacking portion, in which the medium transported from the intermediate stacking portion is stacked on the stacking portion after the leading edge contacts the contact portion positioned at the second position.

A medium treatment apparatus is provided with the medium stacking device, and a post-treatment apparatus that performs a post-treatment on a medium on the intermediate stacking portion.

A method of controlling a medium stacking device is provided with receiving a medium treated by a treatment portion on an intermediate stacking portion, moving a contact portion to a first position to align the medium on the intermediate stacking portion in a transport direction, moving the contact portion to a second position that is separated further from a leading edge of the medium than is the first position, bringing the leading edge of the medium transported from the intermediate stacking portion into contact with the contact portion positioned at the second position, and stacking the medium brought into contact with the contact portion at the second position on a stacking portion.

BRIEF DESCRIPTION OF THE DRAWINGS

FIG. 14 is a table illustrating first reference data.

FIG. 15 is a table illustrating second reference data.

DESCRIPTION OF EXEMPLARY EMBODIMENTS

Hereinafter, a medium treatment system including a medium treatment apparatus according to an embodiment will be described with reference to the drawings. For example, the medium treatment system 11 illustrated in FIG. 1 performs a printing treatment of printing characters and images as a treatment for a medium such as a sheet, a reversing treatment of reversing a printed medium in a process of transporting, and a predetermined post-treatment on a bundle of the stacked media after stacking a plurality of reversed printed media.

Figure 1:
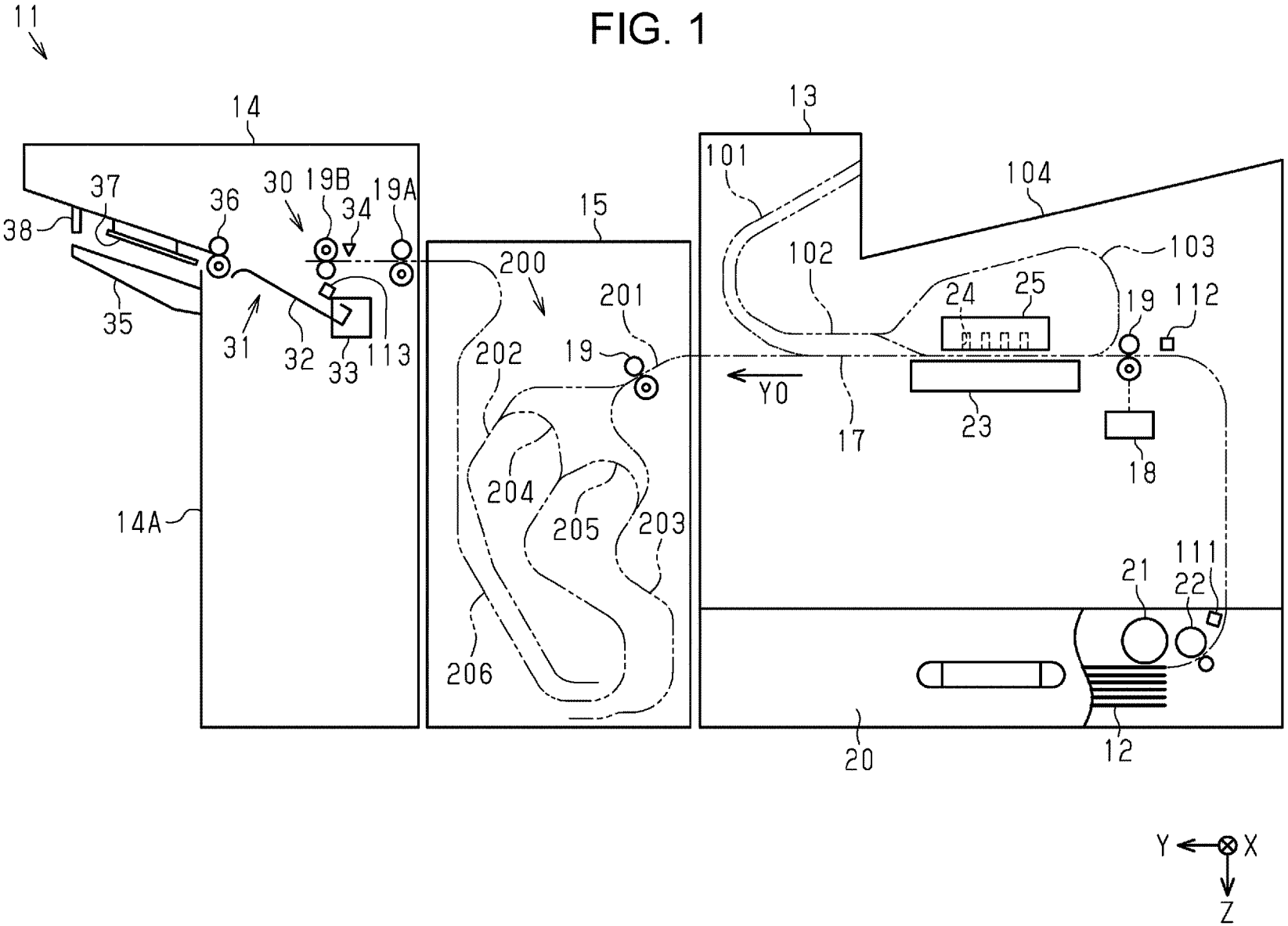
FIG. 1 is a schematic side cross-sectional view illustrating a medium treatment system including a post-treatment apparatus according to an embodiment.

As illustrated in FIG. 1, the medium treatment system 11 is provided with a printing apparatus 13 that prints on a medium 12, a post-treatment apparatus 14 that performs the post-treatment on the printed medium 12, and an intermediate apparatus 15 disposed between the printing apparatus 13 and the post-treatment apparatus 14. For example, the printing apparatus 13 is an ink jet printer that prints characters and images by ejecting an ink that is an example of a liquid onto the medium 12. The post-treatment apparatus 14 performs a stapling treatment for binding a plurality of media 12 as the post-treatment to be performed on the printed media 12. The intermediate apparatus 15 reverses the printed medium 12 carried in from the printing apparatus 13 inside, and thereafter discharges the printed medium 12 to the post-treatment apparatus 14. The post-treatment performed by the post-treatment apparatus 14 on the medium 12 may be punching, shifting, saddle stitching, folding, and the like, in addition to stapling. Here, the punching is a treatment of making punch holes in the medium 12 in units of a predetermined number of sheets, and the shifting is a treatment of alternately shifting and stacking the media 12 to a discharge stacker 35 by a predetermined number of sheets.

The medium treatment system 11 is provided with a transport path 17 illustrated by a two-dot chain line in FIG. 1 that continues from the printing apparatus 13 to the post-treatment apparatus 14 through the intermediate apparatus 15. The printing apparatus 13 and the intermediate apparatus 15 are provided with one or a plurality of transport roller pairs 19 that transport the medium 12 along the transport path 17 by driving a transport motor 18. In addition, the post-treatment apparatus 14 is provided with a transport mechanism 30 that receives and transports the medium 12 after the printing treatment discharged from the intermediate apparatus 15 disposed upstream thereof. The transport mechanism 30 is provided with transport roller pairs 19A and 19B, and discharges the medium 12 after the printing treatment received from the intermediate apparatus 15 onto an intermediate stacker 32 in a housing 14A. The printing apparatus 13 and the intermediate apparatus 15 individually are provided with the transport motor 18 that drives one or more transport roller pairs 19 for each apparatus.

In the drawing, when the medium treatment system 11 is placed on a horizontal plane, a direction of gravity is illustrated by a Z axis, and two directions intersecting each other along a plane intersecting the Z axis are illustrated by an X axis and a Y axis. The X axis, the Y axis, and the Z axis are preferably orthogonal to each other, and the X axis and the Y axis are along the horizontal plane. In the following description, the X-axis direction is also referred to as a width direction X, the Z-axis direction is also referred to as a vertical direction Z, and the direction perpendicular to the width direction X and along the transport path 17 is also referred to as a first transport direction Y0. The first transport direction Y0 is a direction where the transport roller pairs 19, 19A, and 19B transport the medium 12, and changes according to the position of the medium 12 transported from the upstream printing apparatus 13 toward the downstream post-treatment apparatus 14.

The printing apparatus 13 is detachably provided with a cassette 20 that accommodates the medium 12 in a stacked state. A plurality of cassettes 20 may be provided. The printing apparatus 13 is provided with a pickup roller 21 that sends out the uppermost medium 12 among the media 12 accommodated in the cassette 20, and a separation roller 22 that separates the medium 12 sent out by the pickup roller 21 one by one.

The printing apparatus 13 is provided with a support portion 23 that is provided at a position along the transport path 17 and supports the medium 12, and a print head 25 that ejects a liquid from a nozzle 24 and prints on the medium 12 supported by the support portion 23. The print head 25 is provided at a position facing the support portion 23 with the transport path 17 interposed therebetween. The print head 25 may be a line head that can simultaneously eject the liquid across the width direction X, or may be a serial head that ejects the liquid while moving in the width direction X.

The printing apparatus 13 is provided with, a discharge path 101 through which the medium 12 is discharged, a switchback path 102 through which the medium 12 is switched back, and a reverse path 103 through which a posture of the medium 12 is reversed, as a portion of the transport path 17. The medium 12 printed by the print head 25 is discharged to a discharge portion 104 through the discharge path 101.

When performing double-sided printing, the medium 12 printed on single side is transported to the switchback path 102, transported in a reverse direction, and transported from the switchback path 102 to the reverse path 103. The medium 12 reversed by the reverse path 103 is fed again to the print head 25 and is printed by the print head 25 on an opposite-side surface from the already printed surface. In this manner, the printing apparatus 13 performs the double-sided printing on the medium 12. The printing apparatus 13 transports the printed medium 12 toward the discharge portion 104 or the intermediate apparatus 15.

The intermediate apparatus 15 includes a reversing treatment portion 200 that reverses the printed medium carried in from the printing apparatus 13 and discharges the medium to the post-treatment apparatus 14. The reversing treatment portion 200 is provided with an introduction path 201, a first switchback path 202, a second switchback path 203, a first merging path 204, a second merging path 205, and a lead-out path 206, as a portion of the transport path 17. Furthermore, the reversing treatment portion 200 includes a plurality of transport roller pairs 19 (not illustrated) that transport the medium 12 along each of the paths 201 to 206, and a flap (not illustrated) that guides the medium 12 to one of the transport destinations at the branch points of each of the paths 201 to 203. The medium 12 transported from the printing apparatus 13 to the intermediate apparatus 15 is transported from the introduction path 201 to the first switchback path 202 or the second switchback path 203 by the flap.

The medium 12 transported to the first switchback path 202 is switched back by the first switchback path 202, then reversed by the first merging path 204, and transported to the lead-out path 206 after being reversed. On the other hand, the medium 12 transported from the introduction path 201 to the second switchback path 203 is switched back by the second switchback path 203, then reversed by the second merging path 205, and transported to the lead-out path 206 after being reversed. As a result, the medium 12 led out from the intermediate apparatus 15 to the post-treatment apparatus 14 through the lead-out path 206 is in a posture in which a surface printed immediately before by the printing apparatus 13 faces downward. In addition, by transporting through the intermediate apparatus 15, a drying time of the medium 12 is ensured, and the transfer of the liquid ejected to the medium 12, the curl of the medium 12 due to the water of the ejected liquid, and the like can be suppressed.

Next, an embodiment of the post-treatment apparatus 14 will be described.

As illustrated in FIG. 1, the post-treatment apparatus 14 includes the transport mechanism 30 that receives the medium 12 reversed by the reversing treatment portion 200 and discharged into the housing 14A, and transports the received medium 12. In addition, the post-treatment apparatus 14 is provided with a medium stacking device 31 having the intermediate stacker 32 as an example of an intermediate stacking portion, which receives and stacks the medium 12 discharged from the transport mechanism 30, and a post-treatment mechanism 33 that performs the post-treatment on the medium 12 stacked on the intermediate stacker 32. The intermediate stacker 32 receives the medium 12 subjected to the reversing treatment by the reversing treatment portion 200 and discharged. In this regard, the reversing treatment portion 200 corresponds to an example of a treatment portion that treats the medium 12 to be discharged to the medium stacking device 31 before being discharged. In addition, in this example, since the medium 12 received by the intermediate stacker 32 is subjected to the printing treatment by the print head 25 before being discharged to the medium stacking device 31, the print head 25 can be to be an example of a treatment portion.

The transport mechanism 30 includes the carrying transport roller pair 19A for carrying which carries in the medium 12 discharged from the intermediate apparatus 15, and the discharging transport roller pair 19B for discharge which discharges the carried medium 12 to the medium stacking device 31. A sensor 34 that detects the medium 12 to be transported is disposed at a position in the vicinity of the transport mechanism 30.

In addition, as illustrated in FIG. 1, the post-treatment apparatus 14 is provided with the discharge stacker 35 as an example of a stacking portion on which the medium 12 discharged from the intermediate stacker 32 is stacked. The discharge stacker 35 extends outward from the side surface of the housing 14A of the post-treatment apparatus 14. The discharge stacker 35 receives and stacks the medium 12 after the post-treatment, discharged from the intermediate stacker 32 to the outside of the housing 14A. The discharge stacker 35 is provided so as to be movable up and down along the side surface of the housing 14A. Based on the detection result of a detection portion (not illustrated) that detects a stacking height of the medium 12 to be stacked, the discharge stacker 35 is lowered as a stacking amount increases so that the medium 12 discharged from the medium stacking device 31 can be received.

As illustrated in FIG. 1, the medium stacking device 31 includes a discharge mechanism 36 that transports and discharges the medium 12 on the intermediate stacker 32 in a direction of the discharge stacker 35. The discharge mechanism 36 of this example adopts a roller transport system having the transport roller pair. The discharge mechanism 36 is not limited to the roller transport system, and may be an extrusion system having a pusher (not illustrated) that discharges the medium 12 on the intermediate stacker 32 to the discharge stacker 35 by pushing out the medium 12 from the intermediate stacker 32.

Furthermore, the medium stacking device 31 is provided with a medium support portion 37 that supports a downstream portion in the discharge direction of the medium 12 on the intermediate stacker 32, and a first alignment member 38 as an example of a contact portion, which performs an alignment operation on the medium 12 on the intermediate stacker 32. The medium support portion 37 is positioned vertically above the discharge stacker 35 and also has a function of temporarily supporting the medium 12 transported from the intermediate stacker 32. A pair of medium support portions 37 is provided on both sides with a transport region of the medium 12 interposed therebetween in the width direction X, and are movable in the width direction X according to the size of the medium 12.

As illustrated in FIG. 1, the printing apparatus 13 is provided with a first detection portion 111 that detects a medium thickness as the thickness of the medium 12 at a position before printing, and a second detection portion 112 detects a fiber direction as a direction where a paper fiber extends, when the medium 12 is a sheet. In addition, the printed medium 12 may be curled by absorbing and expanding water in a liquid such as ink attached by printing. As illustrated in FIG. 1, the post-treatment apparatus 14 may be provided with a third detection portion 113 that detects a curl amount as a curl amount generated due to a liquid such as ink on the medium 12.

Next, a detailed configuration of the medium stacking device 31 will be described with reference to FIGS. 2 to 6.

Figure 2:
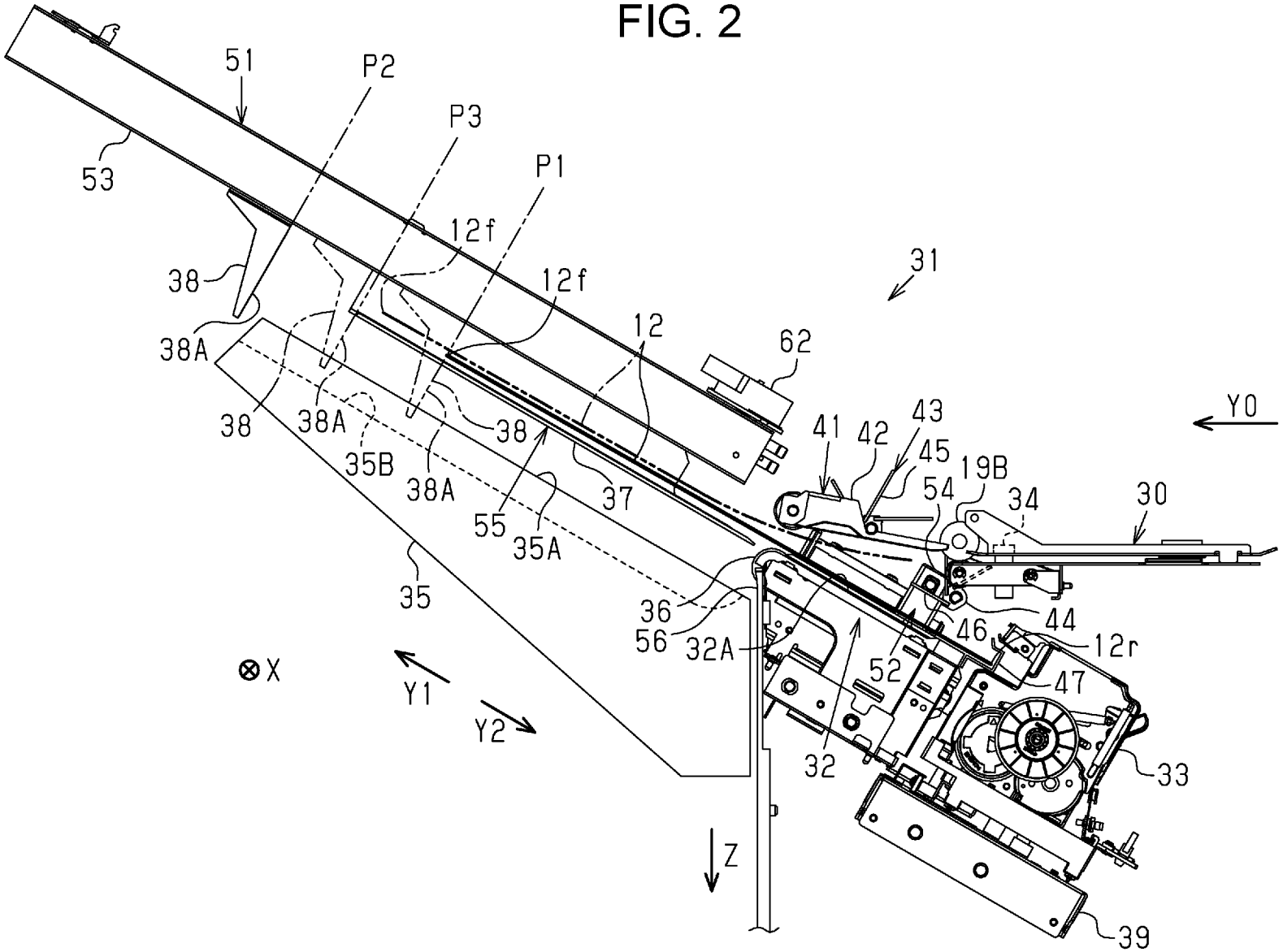
FIG. 2 is a side view illustrating a medium stacking device and a periphery thereof in a post-treatment apparatus.

As illustrated in FIG. 2, the medium stacking device 31 is provided with the intermediate stacker 32, the discharge mechanism 36, the medium support portion 37, the first alignment member 38, and the like, described above. The intermediate stacker 32 includes a stacking surface 32A on which the received medium 12 is stacked. The stacking surface 32A is an inclined surface in which the upstream end is positioned below the vertical direction Z further than the downstream end in a first transport direction Y0. As another component, the medium stacking device 31 is provided with a path change mechanism 41 that changes the path of the medium 12 discharged from the transport mechanism 30 at a predetermined discharge speed to a path along the stacking surface 32A of the intermediate stacker 32. The path change mechanism 41 operates to knock down the medium 12 discharged from the transport mechanism 30 at a predetermined discharge speed, and includes a movable guide 42 that guides the intermediate stacker 32 positioned below.

Figure 5:
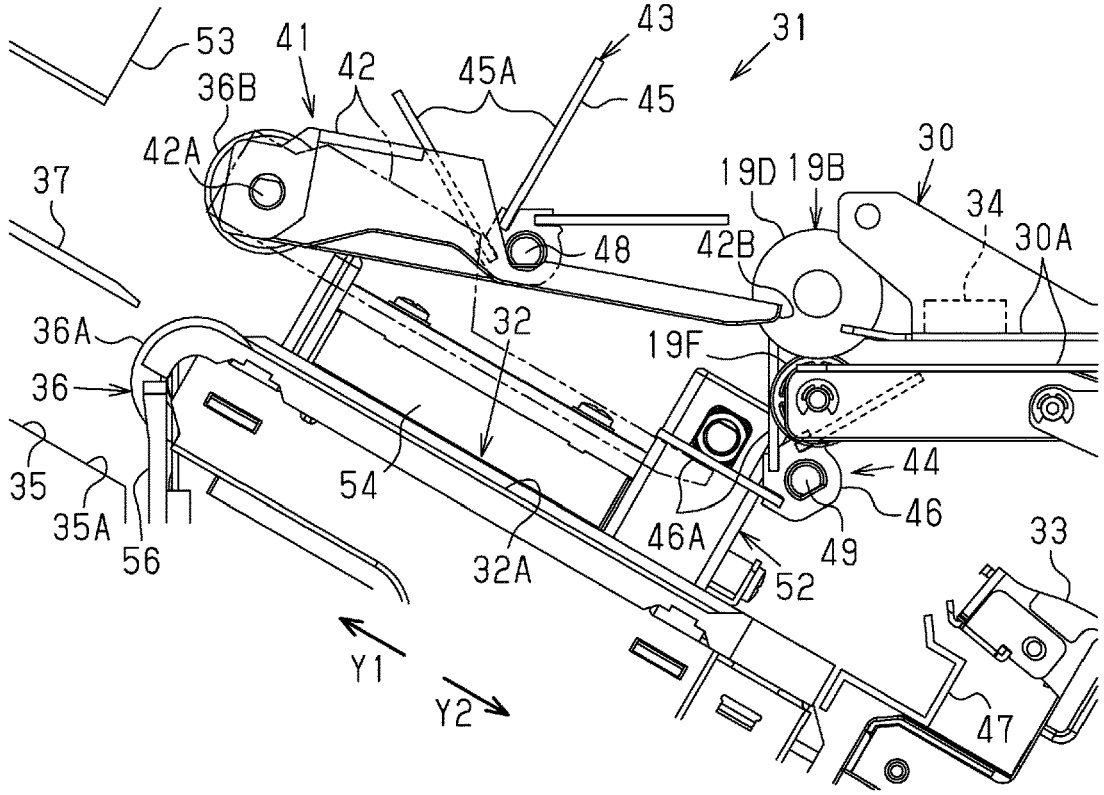
FIG. 5 is a partial side view of the medium stacking device.

In addition, as illustrated in FIGS. 2 and 5, the medium stacking device 31 includes a first feed mechanism 43 that applies a transport force to the medium 12 in a second direction Y2 as a direction opposite to a first direction Y1 as a direction where the medium 12 is discharged along the stacking surface 32A as the path after the change, after the operation of the path change mechanism 41 is started. In addition, the medium stacking device 31 includes a second feed mechanism 44 that applies a transport force to the medium 12 in the second direction Y2 at a position downstream in the second direction Y2 further than the first feed mechanism 43. The first feed mechanism 43 is provided with a rotary first paddle 45 as an example of a feed portion, which contacts the medium 12 while rotating and applies the transport force to the medium 12 in the second direction Y2. In addition, the second feed mechanism 44 is provided with a rotary second paddle 46 as an example of a feed portion, which contacts the medium 12 while rotating and applies the transport force to the medium 12 in the second direction Y2.

Figure 4:
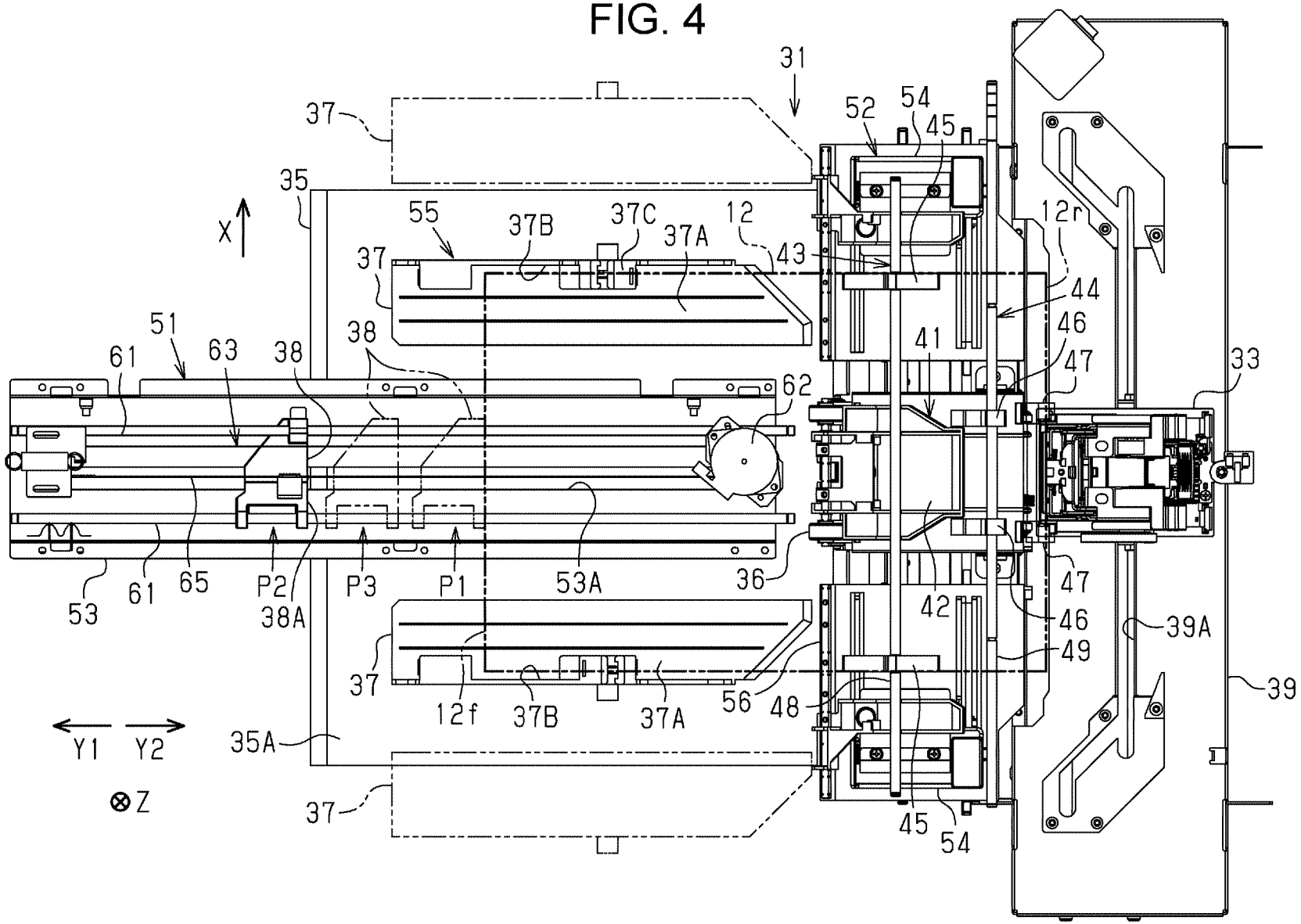
FIG. 4 is a plan view illustrating the medium stacking device and the periphery thereof.

As illustrated in FIGS. 2 and 5, the intermediate stacker 32 includes a medium abutment portion 47 that aligns the medium 12 by contacting a trailing edge 12*r* of the medium 12. The medium abutment portion 47 extends upward from the downstream end portion of the intermediate stacker 32 in the second direction Y2 in a predetermined shape, and has a surface portion orthogonal to the stacking surface 32A in the side views of FIGS. 2 and 5. The paddles 45 and 46 described above apply a force to the medium 12 on the intermediate stacker 32 in a direction toward the medium abutment portion 47. The medium 12 sent in the second direction Y2 by the first feed mechanism 43 and the second feed mechanism 44 is positioned in the second direction Y2 with the abutting position as a reference when the trailing edge 12*r*, which is a downstream end in the second direction Y2, abuts on the medium abutment portion 47. As illustrated in FIG. 4, a plurality of medium abutment portions 47 are provided at intervals in the width direction X. The intervals between the plurality of medium abutment portions 47 are set so that the medium 12 having the minimum width can be abutted at a plurality of locations.

Here, the first direction Y1 is also a discharge direction where the medium 12 is discharged toward the discharge stacker 35 along the stacking surface 32A of the intermediate stacker 32. In addition, the second direction Y2 is also a transport direction when the medium 12 received by the intermediate stacker 32 is transported until the medium 12 abuts against the medium abutment portion 47 along the stacking surface 32A. Therefore, in the following, the direction along the stacking surface 32A of the intermediate stacker 32 may be referred to as "first direction Y1".

As illustrated in FIG. 2, the medium stacking device 31 is provided with a first alignment mechanism 51 as an example of a first alignment portion, which aligns the medium 12 on the intermediate stacker 32 in the first direction Y1, and a second alignment mechanism 52 as an example of a second alignment portion, which aligns the medium 12 on the intermediate stacker 32 in the width direction X. The first alignment mechanism 51 includes a long support frame 53 extending in the first direction Y1 above the discharge stacker 35, the above-described first alignment member 38 capable of reciprocating in the first direction Y1 along the lower surface of the support frame 53, and the medium abutment portion 47. The first alignment member 38 moves in an upper position facing the discharge stacker 35 substantially parallel to a stacking surface 35A. In addition, the second alignment mechanism 52 is provided with a pair of second alignment members 54 that can move in the width direction X along the stacking surface 32A of the intermediate stacker 32. The discharge stacker 35 has a recessed portion 35B in the stacking surface 35A that avoids contact with the first alignment member 38 (refer to FIGS. 2 and 3).

As illustrated in FIGS. 2 and 4, the first alignment member 38 is provided so as to be movable between a first position P1 for performing an alignment operation on the medium 12 on the intermediate stacker 32, and a second position P2 that is separated further from a leading edge 12*f* of the medium 12 than is the first position P1. The first alignment member 38 applies a force to the medium 12 on the intermediate stacker 32 in a direction toward the medium abutment portion 47 at the first position P1. When the medium 12 carried in from the reversing treatment portion 200 is discharged from the transport mechanism 30, the first alignment member 38 is positioned at a third position P3 that is a position between the first position P1 and the second position P2.

In FIG. 2, the position when the medium 12 whose path is changed by the operation of the path change mechanism 41 reaches the most downstream when discharged from the transport mechanism 30 in the first transport direction Y0 is illustrated by a two-dot chain line. The third position P3 is a position where the leading edge 12*f* of the medium 12 illustrated by the two-dot chain line does not contact an alignment surface 38A. Therefore, the leading edge 12*f* of the medium 12 discharged from the transport roller pair 19B in the first transport direction Y0 normally does not contact the first alignment member 38 at the third position, and only the medium 12 that is rarely discharged vigorously comes into contact with the first alignment member 38 at the leading edge 12*f*. In the present embodiment, by disposing the first alignment member 38 at the third position P3, the medium 12 having the momentum discharged from the transport roller pair 19B and above the intermediate stacker 32 is brought into contact with the alignment surface 38A. Therefore, it restricts the discharged medium 12 from going too far downstream in the first transport direction Y0.

In FIG. 2, the medium 12 received on the stacking surface 32A is illustrated by a solid line, and in FIG. 4, the medium 12 received on the stacking surface 32A is indicated by a two-dot chain line. The first alignment member 38 moves from the third position P3 to the first position P1 and comes into contact with the leading edge 12*f* of the medium 12, and thus the trailing edge 12*r* of the medium 12 reliably abuts against the medium abutment portion 47. That is, the first alignment operation for aligning the medium 12 in the first direction Y1 is performed by interposing the medium 12 on the intermediate stacker 32 between the first alignment member 38 and the medium abutment portion 47 in the first direction Y1.

The second position P2 is a position where the first alignment member 38 is disposed when the discharge mechanism 36 is driven and the medium 12 is discharged from the intermediate stacker 32. In this example, the first alignment member 38 moves from the first position P1 to the second position P2 when the first alignment operation of the final medium 12 among the target number of sheets to be stacked on the intermediate stacker 32 is completed. Therefore, when the discharge mechanism 36 is driven after the second alignment operation performed after the first alignment operation for the final medium 12, the first alignment member 38 is positioned at the second position P2.

The medium 12 discharged from the intermediate stacker 32 is stacked on the discharge stacker 35 after the leading edge 12*f* contacts the alignment surface 38A of the first alignment member 38 at the second position P2. At this time, the medium support portion 37 that supports a leading edge portion of the medium 12 before the medium 12 is discharged from the intermediate stacker 32 retracts to a position where the medium 12 cannot be supported in the width direction X before or after the leading edge 12*f* of the medium 12 contacts the first alignment member 38 at the second position P2. As a result, after the leading edge 12*f* comes into contact with the alignment surface 38A, the medium 12 falls and is stacked on the discharge stacker 35. Therefore, the first position P1, the second position P2, and the third position P3 of the first alignment member 38 are changed according to the size of the medium 12.

That is, the distance in the first direction Y1 between the alignment surface 38A of the first alignment member 38 at the first position P1 and the medium abutment portion 47 is equal to a length (medium length) of the medium 12 in the first direction Y1. In addition, the distance in the first direction Y1 between the alignment surface 38A of the first alignment member 38 at the second position P2 and a nip position of the discharge mechanism 36 is longer than the length of the medium 12 in the first direction Y1 by a first predetermined distance. The first predetermined distance is set to a value at which the leading edge 12*f* of the media bundle 12B discharged from the discharge mechanism 36 contacts, and is a value within a range of 5 to 50 mm as an example.

The distance on the transport path between the alignment surface 38A of the first alignment member 38 at the third position P3 and a nip position of the transport roller pair 19B constituting the transport mechanism 30 is longer than the length of the medium 12 in the first direction Y1 by a second predetermined distance. The second predetermined distance is set to a value at which the leading edge 12*f* of the medium 12 does not reach the alignment surface 38A according to a discharge speed of the medium 12 from the transport roller pair 19B, and is a value within a range of 10 to 100 mm as an example. In this example, the second predetermined distance is set to a value that is desired to remain so far even if an arrival position of the leading edge 12*f* of the medium 12 exceeds a normal arrival position.

In this example, the first predetermined distance is set to a value shorter than the second predetermined distance. However, the first predetermined distance is determined from a desired drop position on the stacking surface 35A of the media bundle 12B, and the second predetermined distance is a value determined according to the discharge speed of the medium 12 from the transport mechanism 30 and the like. In this regard, the first predetermined distance and the second predetermined distance may be the same value, the first predetermined distance may be longer than the second predetermined distance, or may be values outside the range indicated by the numerical value (mm).

Figure 3:
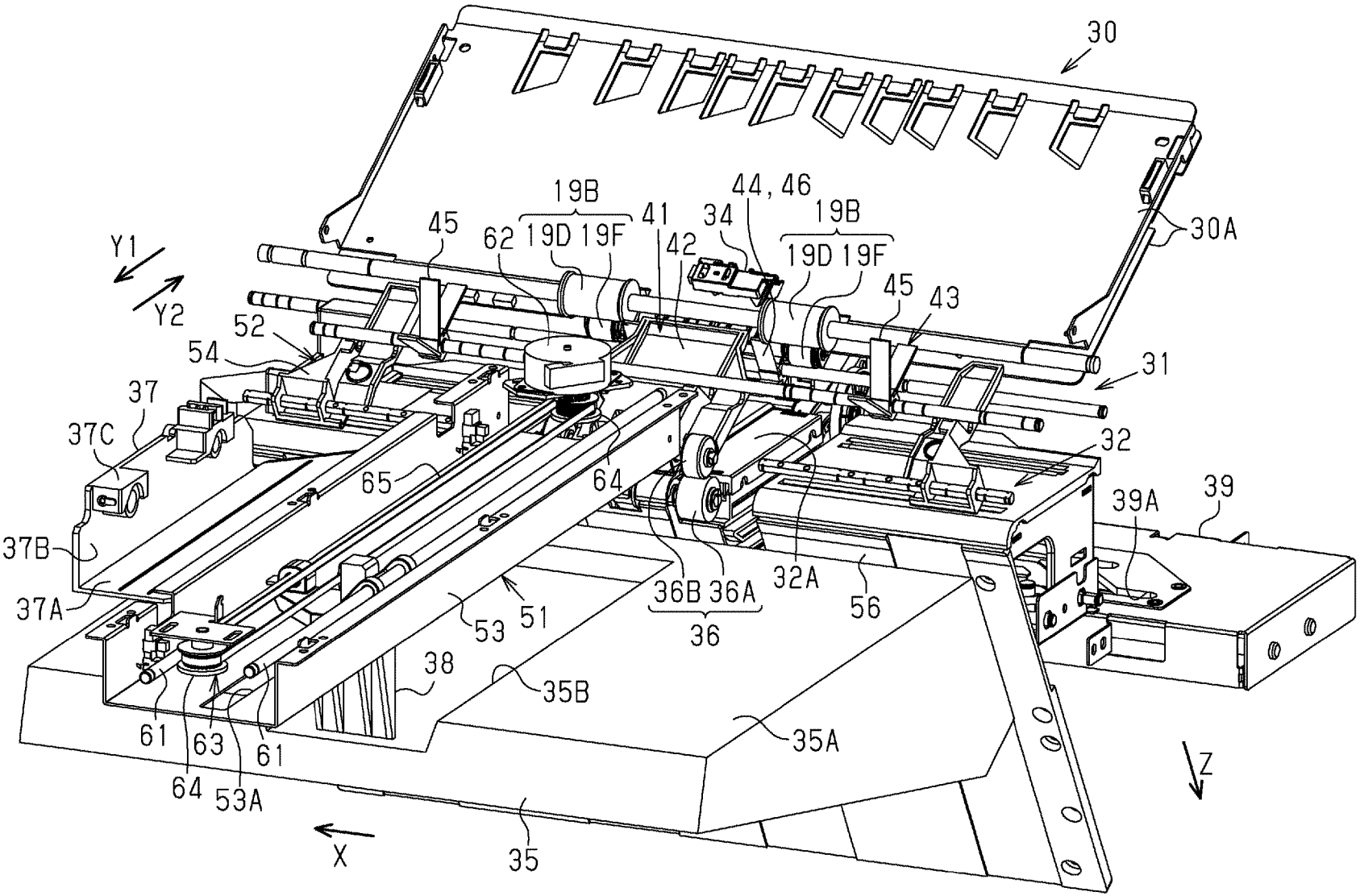
FIG. 3 is a perspective view illustrating the medium stacking device and the periphery thereof.

In addition, as illustrated in FIGS. 2 to 4, the medium stacking device 31 is provided with a medium support mechanism 55 having a pair of medium support portions 37. The medium support portion 37 supports the leading edge portion of the medium 12 stacked on the intermediate stacker 32. The medium support mechanism 55 moves the pair of medium support portions 37 in the width direction X. As illustrated in FIGS. 2 and 4, the pair of medium support portions 37 includes a support surface 37A that supports the lower surface of the medium 12, and a guide surface 37B that guides side edges of the medium 12.

The support surface 37A extends along the first direction Y1 at the same position as a virtual surface or at a position slightly below the virtual surface obtained by extending the stacking surface 32A of the intermediate stacker 32 in the first direction Y1. An upstream end of the support surface 37A in the first direction Y1 is positioned in the vicinity of the discharge mechanism 36. As illustrated in FIG. 4, the pair of medium support portions 37 moves in the width direction X between a support position illustrated by a solid line in FIG. 4 and capable of holding the medium 12 on the pair of support surfaces 37A, and a retracted position illustrated by a two-dot chain line in FIG. 4, for example, and where the medium 12 cannot be held on the pair of support surfaces 37A. The support position is a position at which the interval between the pair of guide surfaces 37B is longer than the width of the medium 12 by a predetermined distance so that the medium 12 can be guided in the width direction X by the pair of guide surfaces 37B. As illustrated in FIGS. 2 and 4, in a state where the pair of medium support portions 37 is disposed at the support position, among the medium 12 received by the intermediate stacker 32, the downstream portion extending downstream in the first direction Y1 further than the discharge mechanism 36 is supported by the support surface 37A. In addition, when the pair of medium support portions 37 is at the support position, since the side edges of the medium 12 are guided by the guide surface 37B, in the medium 12 stacked on the intermediate stacker 32, the deviation in the width direction X falls within an allowable range. In addition, when the pair of medium support portions 37 moves from the support position to the retracted position in the width direction X, the media bundle 12B held on the pair of support surfaces 37A until then falls.

The pair of medium support portions 37 supports the leading edge portion of the medium 12 stacked on the intermediate stacker 32, so that hanging-down of the leading edge portion is suppressed. Here, since the stacking surface 35A of the discharge stacker 35 is lower further than the virtual surface obtained by extending the stacking surface 32A of the intermediate stacker 32 in a downstream direction, when the leading edge portion of the medium 12 is not supported, the leading edge portion of the medium 12 hangs down and contacts the stacking surface 35A. When the media bundle 12B is discharged while the leading edge portion is in the hanging-down state, there is a possibility that the leading edge portion may be wound inward and folded. The pair of medium support portions 37 is provided in order to prevent the leading edge portion from hanging down which causes this type of folding.

As illustrated in FIGS. 3 and 4, the intermediate stacker 32 has a predetermined length in the width direction X. The intermediate stacker 32 of this example has a predetermined length longer than the width of the maximum width of the medium 12 in the width direction X. The center position of the intermediate stacker 32 in the width direction X is a center of the width of the medium 12 received on the stacking surface 32A. The movable guide 42 is positioned above the center portion of the width of the intermediate stacker 32. Therefore, the movable guide 42 changes the path of the medium 12 by striking the center portion of the medium 12 discharged from the transport mechanism 30 in the width direction X. A plurality of movable guides 42 may be provided at different positions in the width direction X. In this case, the movable guide 42 at the center portion may be operated when the medium 12 has a small size including the minimum width, and the plurality of movable guides 42 may be operated when the medium 12 has a large size including the maximum width.

As illustrated in FIG. 4, a pair of first paddles 45 is fixed to a rotating shaft 48 that is pivotally supported in a state of extending in the width direction X above the intermediate stacker 32. The pair of first paddles 45 is disposed at respective positions separated by a predetermined interval (first interval) in the width direction X. The pair of first paddles 45 is in positions that can contact the medium 12 with a first size having a width equal to or larger than a predetermined dimension at two locations in the width direction X. On the other hand, the second paddle 46 is fixed to a rotating shaft 49 that is pivotally supported in a state of extending in the width direction X at a position above the intermediate stacker 32 and downstream in the second direction Y2 further than the rotating shaft 48. A pair of second paddles 46 is positioned in the width direction X with a second interval narrower than the first interval of the pair of first paddles 45. The pair of second paddles 46 is in positions that can contact the medium 12 with a second size having a width less than a predetermined dimension at two locations in the width direction X.

The rotating shaft 48 illustrated in FIG. 4 is coupled to an electric motor (all are not illustrated) as a drive source through a belt-type power transmission mechanism, for example, in a state where power can be transmitted. In addition, the rotating shaft 49 is coupled to an electric motor (all are not illustrated) as a drive source through a belt-type power transmission mechanism, for example, in a state where power can be transmitted. Therefore, the first paddle 45 and the second paddle 46 are driven independently.

As illustrated in FIG. 5, the first paddle 45 has a plurality of blades 45A extending in the radial direction with an interval in a direction around an axis of the rotating shaft 48. The second paddle 46 includes a plurality of blades 46A extending in the radial direction with an interval in a direction around an axis of the rotating shaft 49. A length dimension of the blade 45A of the first paddle 45 is longer than a length dimension of the blade 46A of the second paddle 46. That is, the first paddle 45 is a large paddle with a long blade 45A, and the second paddle 46 is a small paddle with a short blade 46A. The blades 45A and 46A have a length that allows contact with the stacking surface 32A. In addition, each of the first paddle 45 and the second paddle 46 have three blades 45A and 46A positioned in a predetermined angle range of less than 180 degrees in a circumferential direction, and can be stopped at a retracted position that is a rotation angle at which none of the blades 45A, 46A is in contact with the media bundle 12B on the stacking surface 32A. Examples of the material of the blades 45A and 46A include elastic materials such as rubber and elastomer, and synthetic resins such as polyethylene terephthalate (PET). In addition, the blades 45A and 46A are preferably members in the form of elastic sheets.

The first paddle 45 and the second paddle 46 perform a feeding operation of feeding the medium 12 whose path is changed by the rotation of the movable guide 42 when discharged from the transport roller pair 19B in the first transport direction Y0 in a direction where the trailing edge 12*r* abuts against the medium abutment portion 47 by rotating in a counterclockwise direction in FIG. 5.

Even if the discharge speed from the transport mechanism 30 is the same, the medium 12 having a large size requires a larger force than that of the medium 12 having a small size in order to overcome the inertia of the medium 12 discharged at a predetermined discharge speed and change the path. In addition, the medium 12 having a large size requires a larger transport force in the second direction Y2 than that of the medium 12 having a small size. Therefore, for the medium 12 having a large size, a braking force against inertia in a discharge direction is applied in the process of changing the path also by the first paddle 45 having a large diameter, and a transport force in the second direction Y2 is applied to the medium 12 after braking by the first paddle 45 and the second paddle 46.

On the other hand, for the medium 12 having a small size, since the force due to the inertia in the discharge direction is relatively small compared to the large size, a transport force in the second direction Y2 is applied only by the second paddle 46. The first paddle 45 and the second paddle 46 rotate in the counterclockwise direction in FIG. 2, and pull the medium 12 received on the intermediate stacker 32 back in the second direction Y2 toward the medium abutment portion 47.

As illustrated in FIG. 5, the transport mechanism 30 is provided with two path forming plates 30A that face each other with a predetermined gap, the above-described upstream transport roller pair 19A (refer to FIG. 1), and the downstream transport roller pair 19B, which transport the medium 12 along the path between the two path forming plates 30A. The path forming plate 30A is provided with a sensor 34 that detects the medium 12 at a position upstream further than the transport roller pair 19B. The transport roller pair 19B positioned at the discharge port of the transport mechanism 30 includes a driving roller 19D and a driven roller 19F that rotates with the driving roller 19D.

The movable guide 42 illustrated in FIG. 5 is a rotary type that rotates within a predetermined angle range around a rotating shaft 42A at the downstream end portion in the first transport direction Y0. The movable guide 42 rotates between a standby position illustrated by a solid line in FIG. 5 and an operation position illustrated by a two-dot chain line in same drawing, and rotated by a predetermined angle in the clockwise direction in the drawing from the standby position. A leading edge 42B, which is an upstream end of the movable guide 42, is positioned in the vicinity of the upper portion of the discharge port of the transport roller pair 19B. That is, the medium 12 discharged from the transport roller pair 19B moves in the first transport direction Y0 at a position below the movable guide 42 when in the standby position. The movable guide 42 is rotated from the standby position toward the operating position, so that the center portion of the width of the discharged medium 12 is knocked down and the medium 12 is guided to the stacking surface 32A of the intermediate stacker 32 that is the receiving destination.

As illustrated in FIG. 5, the discharge mechanism 36 includes a driving roller 36A positioned at the downstream end portion of the intermediate stacker 32 in the first direction Y1, and a driven roller 36B that rotates with the rotation of the driving roller 36A when in the nip position. In the present embodiment, the driven roller 36B is pivotally supported on a base edge portion of the movable guide 42. The driven roller 36B moves between the nip position illustrated in FIG. 6 where the medium 12 or the media bundle 12B can be nipped between the driving roller 36A, and a separation position (release position) illustrated in FIG. 5 separated from the driving roller 36A.

Figure 6:
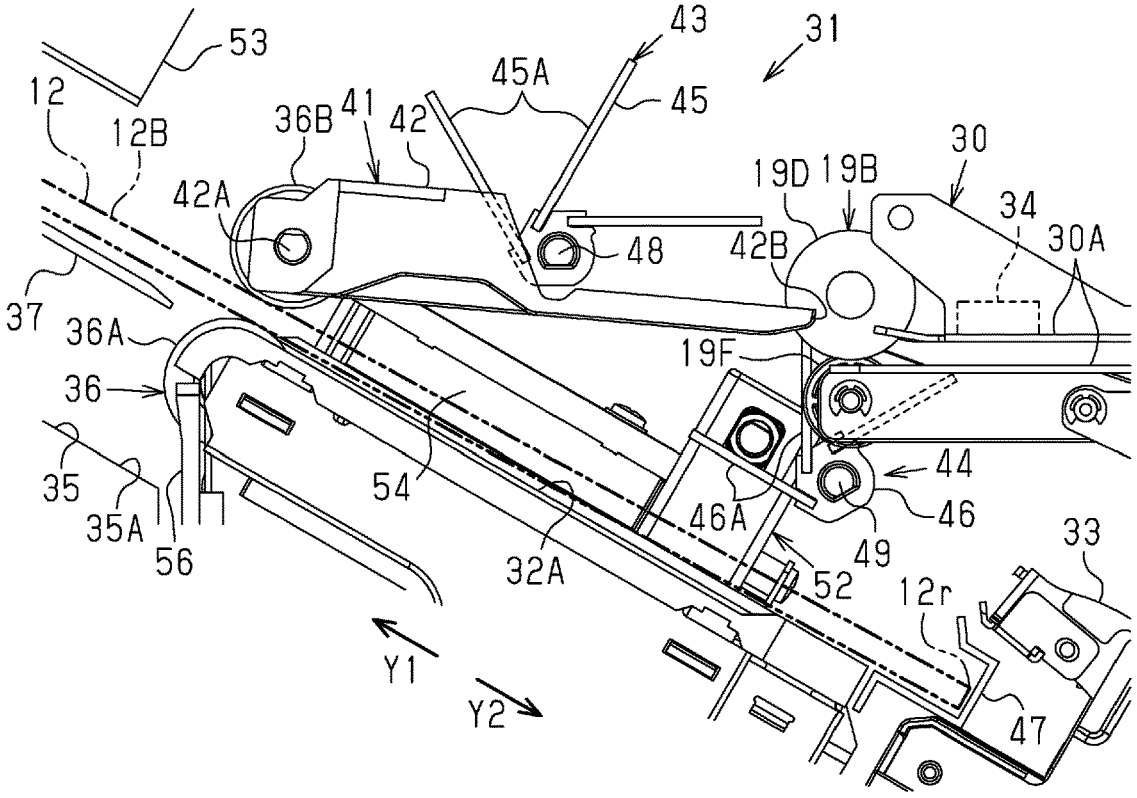
FIG. 6 is a partial side view when a media bundle is discharged in the medium stacking device.

The movement of the driven roller 36B between the nip position and the separation position is performed by the movable guide 42 rotating with a position in the vicinity of the leading edge 42B as a rotation fulcrum to change the posture. Therefore, even if the movable guide 42 changes the posture thereof in order to move the driven roller 36B between the nip position and the separation position, the position of the leading edge 42B thereof is held in the vicinity of the upper portion of the discharge port of the transport roller pair 19B. That is, the movable guide 42 moves the driven roller 36B between the nip position and the separation position by changing the posture angle while holding the leading edge 42B in the vicinity of the upper portion of the discharge port of the transport roller pair 19B. The driven roller 36B is urged in a direction approaching the driving roller 36A by a spring (not illustrated). Therefore, when the driven roller 36B illustrated in FIG. 6 is at the nip position, the media bundle 12B illustrated by a two-dot chain line in FIG. 6 is nipped between the driving roller 36A and the driven roller 36B.

The number of stacked media 12 stacked on the intermediate stacker 32 changes according to the set number in the post-treatment condition information set by the user. Therefore, the thickness of the media bundle 12B after the post-treatment changes according to the set number of media 12 to be post-treated. When the driven roller 36B moves to the nip position while the medium 12 is stacked on the intermediate stacker 32, the media bundle 12B is nipped between the driving roller 36A and the driven roller 36B. When the media bundle 12B is discharged from the intermediate stacker 32, the discharge mechanism 36 is driven, and the media bundle 12B is discharged in the first direction Y1 by the rotation of the rollers 36A and 36B that nip the media bundle 12B.

As illustrated in FIGS. 2, 3, and 5, an outer surface of the wall portion extending downward from the downstream end of the intermediate stacker 32 in the first direction Y1 is a standing wall 56 that is suspended along the vertical direction Z. The stacking surface 35A configured to include the upper surface of the discharge stacker 35 is formed on a slope whose base edge side is lower in the vertical direction Z further than the leading edge side. When the media bundle 12B on the intermediate stacker 32, illustrated by a two-dot chain line in FIG. 6 is discharged to the discharge stacker 35, the upper surface of the stacking surface 35A or the preceding media bundle 12B previously stacked thereon is slid down and the trailing edge 12*r* strikes the standing wall 56 to be aligned in the first direction Y1 (refer to FIG. 23).

Next, detailed configurations of the first alignment mechanism 51 and the second alignment mechanism 52 will be described.

First, the configuration of the first alignment mechanism 51 will be described with reference to FIGS. 3 and 4. As illustrated in FIGS. 3 and 4, the first alignment mechanism 51 is provided with the first alignment member 38, two guide shafts 61 that movably guide the first alignment member 38, an electric motor 62 that serves as a drive source, and the power transmission mechanism 63 that transmits the driving force of the electric motor 62 to the first alignment member 38. The electric motor 62 and the power transmission mechanism 63 are assembled to the long support frame 53.

As illustrated in FIG. 3, the power transmission mechanism 63 includes a pair of pulleys 64 and a timing belt 65 wound around the pair of pulleys 64. One pulley 64 is coupled to an output shaft of the electric motor 62. The first alignment member 38 is fixed to a portion of the timing belt 65. The first alignment member 38 extends downward through a guide hole 53A that opens at a bottom portion of the support frame 53. When the electric motor 62 is driven to rotate forward, the first alignment member 38 moves in the second direction Y2 approaching the medium abutment portion 47 of the intermediate stacker 32. On the other hand, when the electric motor 62 is driven to rotate reverse, the first alignment member 38 moves in the first direction Y1 away from the medium abutment portion 47.

In the present embodiment, as illustrated in FIGS. 2 and 4, the first alignment member 38 moves at the three positions P1 to P3 described above on the movement path thereof according to the length of the medium 12 in the first transport direction Y0. That is, the first alignment member 38 moves between the first position P1 performing an alignment operation on the medium 12 on the intermediate stacker 32, and the second position P2 that is a position separated further from the leading edge 12*f* of the medium 12 than is the first position P1. When the medium 12 after the post-treatment on the intermediate stacker 32 is discharged to the discharge stacker 35, the first alignment member 38 is disposed at the second position P2. In addition, the first alignment member 38 is disposed at the third position P3 that is a position between the first position P1 and the second position P2 when the medium 12 is discharged from the reversing treatment portion 200. That is, when the transport mechanism 30 that receives and transports the medium 12 discharged from the reversing treatment portion 200 discharges the medium 12, the first alignment member 38 is disposed at the third position P3. The third position P3 is a position where the first alignment member 38 is retracted while the medium is being stacked on the intermediate stacker 32, and is set to a position downstream further than the most downstream position where the leading edge 12*f* of the discharged medium 12 is assumed to reach the most downstream in the first transport direction Y0 by a predetermined transport distance. Therefore, the medium 12 stacked on the intermediate stacker 32 does not normally strike the first alignment member 38. However, due to irregular reasons in the process of receiving the medium 12 on the intermediate stacker 32, when the assumed most downstream position is moved further downstream, the downstream movement is restricted and defined to a certain position.

Next, a detailed configuration of the second alignment mechanism 52 will be described with reference to FIG. 7.

Figure 7:
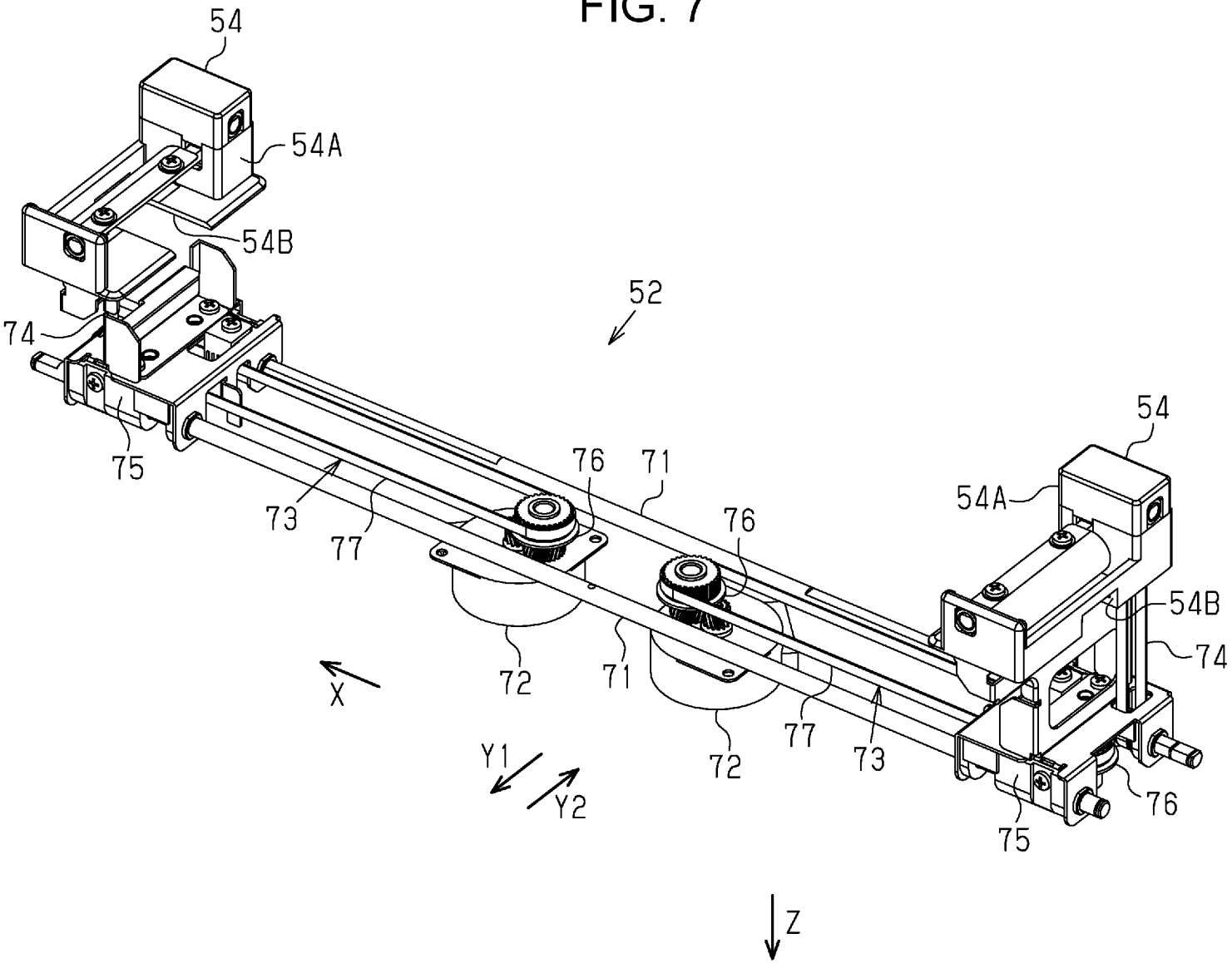
FIG. 7 is a perspective view illustrating a second alignment mechanism.

As illustrated in FIG. 7, the second alignment mechanism 52 is provided with a pair of second alignment members 54 that aligns the medium 12 on the intermediate stacker 32 in the width direction X, and two guide shafts 71 that guide the pair of second alignment members 54 to be movable in the width direction X. Furthermore, the second alignment mechanism 52 is provided with two electric motors 72 as drive sources for individually driving the pair of second alignment members 54, and two power transmission mechanisms 73 which transmit the driving force of the two electric motors 72 to the pair of second alignment members 54. The second alignment member 54 is supported by a slider 75 through the support portion 74 extending in the vertical direction Z. The slider 75 moves along the guide shaft 71.

The two power transmission mechanisms 73 are a belt drive system, for example. The power transmission mechanism 73 is provided with a pair of pulleys 76 and an endless timing belt 77 wound around the pair of pulleys 76. These rotate independently and forward and reverse. One of the pair of pulleys is coupled to the output shaft of the electric motor 72. The slider 75 is fixed to a portion of the timing belt 77. The power transmission mechanism 73 may be another drive system such as a ball screw drive system, instead of the belt drive system. In addition, the drive source is not limited to the electric motor 72, and may be an electric cylinder, for example.

As illustrated in FIG. 7, the pair of second alignment members 54 includes an alignment surface 54A facing in the width direction X, and a notch 54B for avoiding contact with a first rib 83 (refer to FIGS. 8 and 11) described later. When the pair of second alignment members 54 moves from the retracted position to the alignment position that narrows the interval in the width direction X, the pair of second alignment members 54 aligns the medium 12 in the width direction X by the alignment surfaces 54A coming into contact with the side edges of the medium 12 in the width direction X. The alignment position of the pair of second alignment members 54 is determined according to the width of the medium 12 stacked on the intermediate stacker 32. The interval between the pair of alignment surfaces 54A when the pair of second alignment members 54 is in the alignment position is equal to the width dimension of the medium 12.

When the electric motor 72 illustrated in FIG. 7 is driven to rotate forward, the pair of second alignment members 54 moves in a direction approaching each other. When the electric motor 72 is driven to rotate reverse, the pair of second alignment members 54 moves in a direction away from each other. In addition, when the pair of electric motors 72 is driven in directions opposite to each other, the pair of second alignment members 54 moves in the width direction X while maintaining the interval between both. As described above, the pair of second alignment members 54 can be moved to change the interval in the width direction X and can be moved in the width direction X while maintaining the interval in the width direction X. The pair of second alignment members 54 is disposed at a retracted position where the medium 12 can be guided in the width direction X according to the size of the medium 12 between the maximum width and the minimum width. When the alignment operation is not performed, the pair of alignment members 54 stands by at a retracted position where the interval between the pair of alignment surfaces 54A facing in the width direction X is slightly wider than the width of the medium 12. The pair of second alignment members 54 can be moved in the width direction X while guiding the medium 12 at the time of the post-treatment, and can move trailing edge corner portions of the medium 12 to an oblique treatment position where the post-treatment mechanism 33 can obliquely strike.

The medium support mechanism 55 illustrated in FIGS. 3 and 4 has a drive system (not illustrated) disposed at a position above the pair of medium support portions 37. This drive system has substantially the same configuration as the drive system of the second alignment mechanism 52 illustrated in FIG. 7. The drive system of the medium support mechanism 55 is provided with two guide shafts inserted into holes of the guide portion 37C illustrated in FIGS. 3 and 4 formed at the upper end portions of the pair of medium support portions 37, two electric motors as drive sources for individually driving the pair of medium support portions 37, and two power transmission mechanisms for transmitting the driving force of each electric motor to each of the pair of medium support portions 37 (all are not illustrated). As the power transmission mechanism, for example, a belt driving system or a rack and pinion mechanism similar to the second alignment mechanism 52 is used. When the electric motor is driven to rotate forward or driven to rotate reverse, the pair of medium support portions 37 individually moves in one direction or in the other direction in the width direction X. Therefore, the pair of medium support portions 37 can be moved to change the interval in the width direction X and can be moved in the width direction X while maintaining the interval. The pair of medium support portions 37 can be moved in the width direction X together with the pair of second alignment members 54 while holding the medium 12 at the time of the post-treatment, and can move trailing edge corner portions of the medium 12 to a predetermined post-treatment position where an oblique binding by the post-treatment mechanism 33 can be performed.

As illustrated in FIG. 4, the post-treatment mechanism 33 moves along a guide groove 39A on a stage member 39 disposed behind the intermediate stacker 32. The guide groove 39A has a groove path that is slightly longer than the width of the medium 12 of the maximum size, extends in the width direction X, and is bent so as to spread obliquely in the first direction Y1 at both ends thereof. Therefore, the post-treatment mechanism 33 can move to an any position in the width direction X at the trailing edge 12*r* of the medium 12 of the maximum size, and can be disposed at an oblique treatment position where the posture can be obliquely changed at the end portion of the groove path and an oblique post-treatment such as oblique binding can be performed on the trailing edge corner portions of the medium 12. In addition, when the oblique post-treatment such as an oblique binding is performed on the trailing edge corner portions of the medium 12 having a size smaller than the maximum size, the pair of medium support portions 37 and the pair of second alignment members 54 move together in the width direction X while maintaining the interval at which the medium 12 is held, and move the trailing edge corner portions of the medium 12 to a position where the post-treatment mechanism 33 when the medium 12 is positioned at the oblique treatment position can perform the oblique post-treatment. Therefore, a post-treatment such as flat striking and oblique striking can be performed on the medium 12 having any size by the post-treatment mechanism 33.

Figure 8:
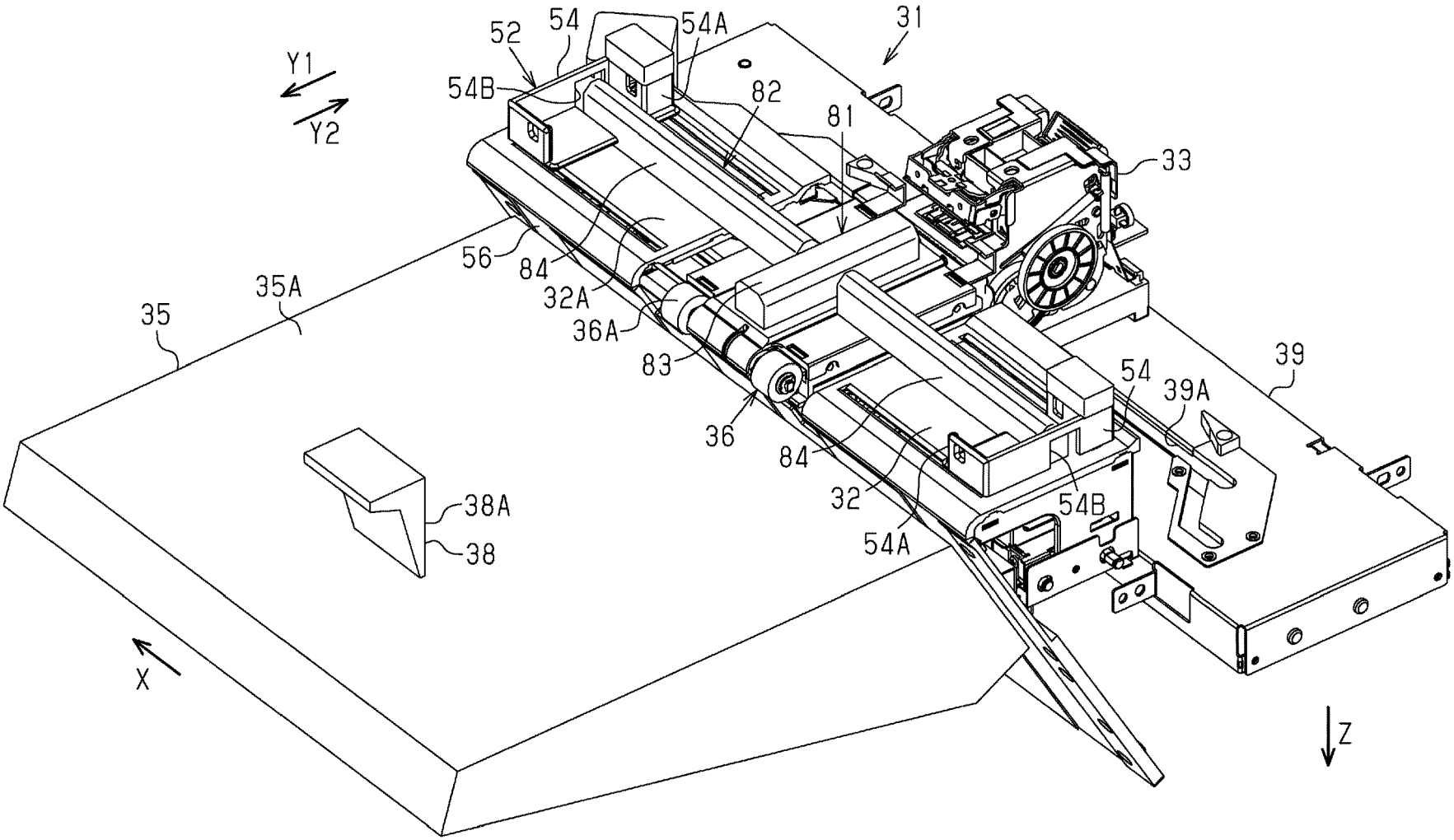
FIG. 8 is a perspective view illustrating the medium stacking device having a first curl forming mechanism and a second curl forming mechanism, and the periphery thereof.

In addition, as illustrated in FIG. 8, the medium stacking device 31 of the present embodiment is provided with a first curl forming mechanism 81 and a second curl forming mechanism 82 that forcibly form curls as examples of deformation on the medium 12 on the intermediate stacker 32. Hereinafter, the configurations of the first curl forming mechanism 81 and the second curl forming mechanism 82 will be described with reference to FIGS. 8, 11, and 12.

Figure 11:
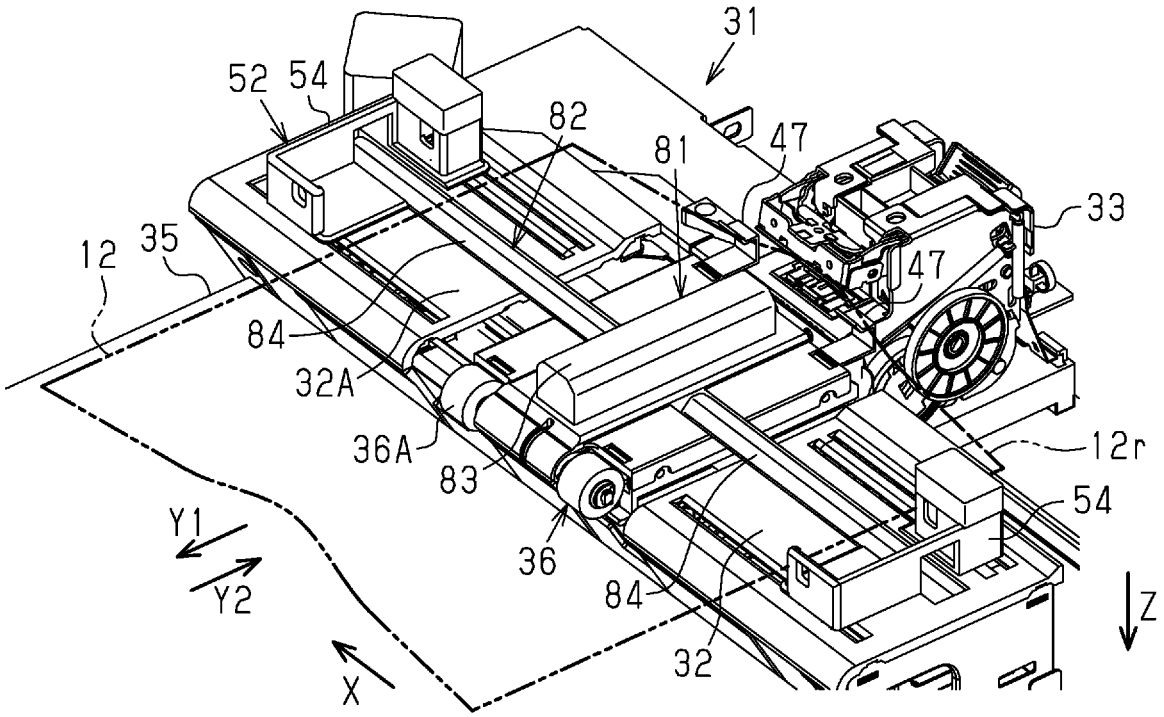
FIG. 11 is a perspective view illustrating a state where a first rib of the first curl forming mechanism is protruded.
Figure 12:
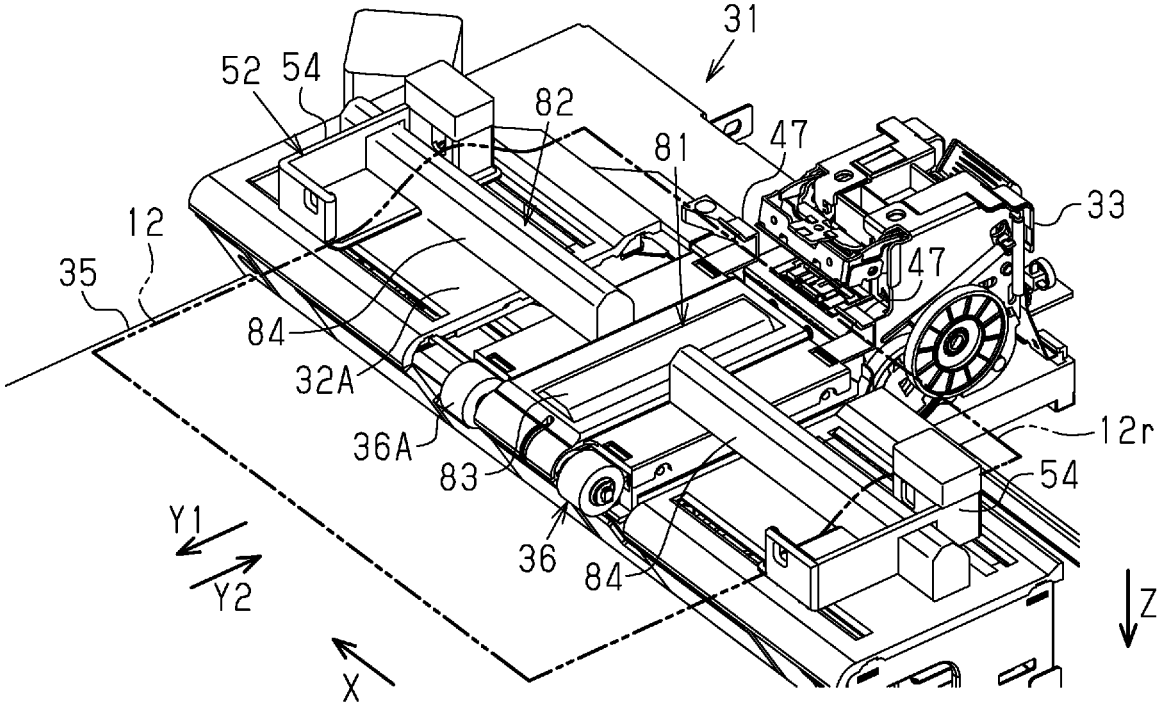
FIG. 12 is a perspective view illustrating a state where a second rib of the second curl forming mechanism is protruded.

As illustrated in FIGS. 8, 11, and 12, the medium stacking device 31 is provided with the first curl forming mechanism 81 for forcibly generating a curl extending in the first direction Y1 as an example of a deformation with tension extending in the first direction Y1 on the medium 12 on the intermediate stacker 32. In addition, the medium stacking device 31 is provided with the second curl forming mechanism 82 for forcibly generating a curl extending in the width direction X as an example of a deformation with tension extending in the width direction X intersecting the first direction Y1 on the medium 12 on the intermediate stacker 32.

The first curl forming mechanism 81 has a first rib 83 extending in a direction along the first direction Y1. The first rib 83 is movable between a protruded state where the intermediate stacker 32 protrudes from the stacking surface 32A by a predetermined amount, and a retracted state where a protrusion amount of the intermediate stacker 32 from the stacking surface 32A is less than a predetermined amount. Here, in the retracted state, the protrusion amount of the first rib 83 may include "0 (zero)". In this example, the first rib 83 moves between the protruded state and the retracted state, and the medium 12 is forcibly deformed in the protruded state, so that a curl C1 extending in the first direction Y1 is formed.

The second curl forming mechanism 82 has a second rib 84 extending in a direction along the width direction X. The second rib 84 is movable between a protruded state where the intermediate stacker 32 protrudes from the stacking surface 32A by a predetermined amount, and a retracted state where the protrusion amount of the intermediate stacker 32 from the stacking surface 32A is less than a predetermined amount. Here, in the retracted state, the protrusion amount of the second rib 84 may include "0 (zero)". In this example, the second rib 84 moves between the protruded state and the retracted state, and the medium 12 is forcibly deformed in the protruded state, so that a curl C2 extending in the width direction X is formed.

Here, the protrusion amount of the first rib 83 and the second rib 84 is based on the stacking surface 32A. The stacking surface 32A has, for example, an irregular surface shape having projection portions and recessed portions in some places, and the protrusion amount of each of the ribs 83 and 84 is based on the highest position of the stacking surface 32A.

As illustrated in FIGS. 8 and 11, the first rib 83 has a predetermined length extending along the first direction Y1 at the center position of the intermediate stacker 32 in the width direction X, and is provided so as to be able to appear and disappear with respect to the stacking surface 32A. The medium 12 received on the intermediate stacker 32 is received in a state where the center of width coincides with the center of width of the intermediate stacker 32 regardless of the size. Therefore, the first rib 83 extending in the first direction Y1 is positioned on the rear side of the center of the width of the medium 12 with any size received on the stacking surface 32A.

In addition, as illustrated in FIGS. 8 and 12, the second rib 84 has a predetermined length extending along the width direction X in the vicinity of the center of the intermediate stacker 32 in the first direction Y1, and is provided so as to be able to appear and disappear with respect to the stacking surface 32A. The second rib 84 extends over a region that is slightly longer than the length over the entire region where the medium 12 having the maximum width is disposed in the width direction X.

The first rib 83 and the second rib 84 are provided in a state of intersecting each other on the intermediate stacker 32. Specifically, the extending directions of the first rib 83 and the second rib 84 are orthogonal to each other, and intersect each other in a cross shape on the stacking surface 32A of the intermediate stacker 32 in plan view. Therefore, in this example, two second ribs 84 are disposed separately on both sides interposing the first rib 83.

Next, the configurations of the first curl forming mechanism 81 and the second curl forming mechanism 82 will be described with reference to FIGS. 9 and 10.

Figure 9:
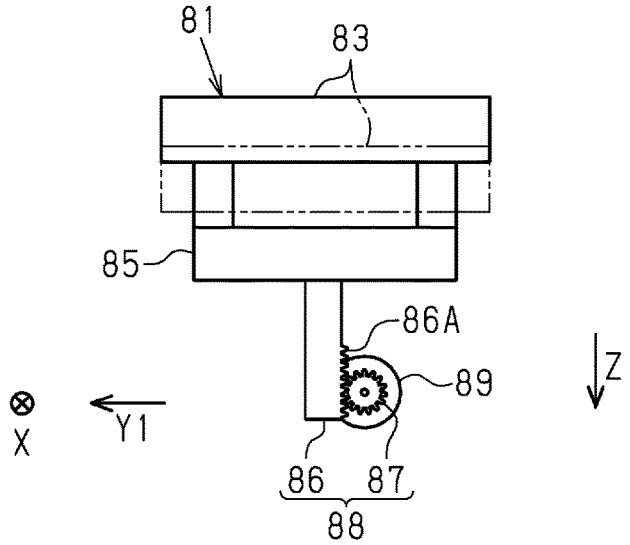
FIG. 9 is a schematic side view illustrating the first curl forming mechanism.

As illustrated in FIG. 9, the first rib 83 is provided so that the first rib 83 can be raised and lowered. The first curl forming mechanism 81 is provided with a support member 85 that supports the first rib 83, a rack and pinion mechanism 88 having a rack 86 extending in the vertical direction Z from the support member 85 and a gear 87 (pinion) meshing with a tooth portion 86A of the rack 86, and an electric motor 89 that rotationally drives the gear 87. When the electric motor 89 is driven to rotate forward, the first rib 83 moves from a retracted state having a protrusion amount less than a predetermined amount (including "0") and illustrated by a two-dot chain line in FIG. 9 to a protruded state protruding by a predetermined amount and illustrated by a solid line in the same drawing. On the other hand, when the electric motor 89 is driven to rotate reverse, the first rib 83 moves from the protruded state illustrated by the solid line in FIG. 9 to the retracted state illustrated by the two-dot chain line in the same drawing.

Figure 10:
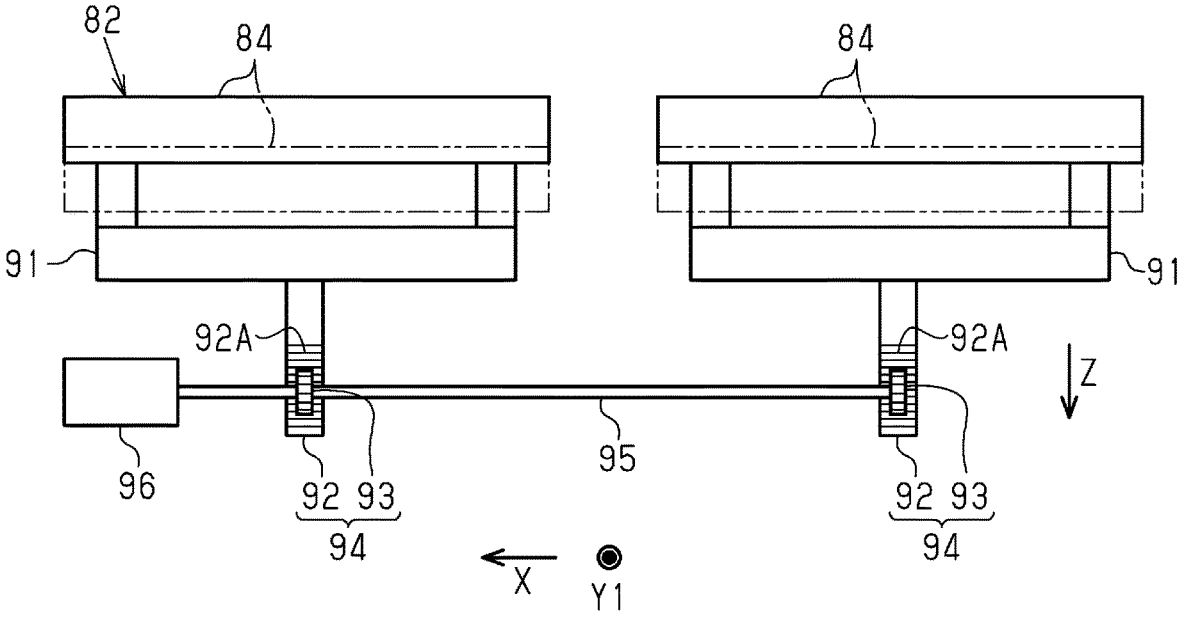
FIG. 10 is a schematic front view illustrating the second curl forming mechanism.

In addition, as illustrated in FIG. 10, the second rib 84 is provided so that the second rib 84 can be raised and lowered. The second curl forming mechanism 82 is provided with a support member 91 that supports the two second ribs 84, a rack and pinion mechanism 94 having a rack 92 extending in the vertical direction Z from the two support member 91 and a gear 93 (pinion) meshing with a tooth portion 92A of the rack 92, and an electric motor 96 that rotationally drives a rotating shaft 95 coupling the two gears 93. When the electric motor 96 is driven to rotate forward, the second rib 84 moves from a retracted state having a protrusion amount less than a predetermined amount (including "0") and illustrated by a two-dot chain line in FIG. 10 to a protruded state protruding by a predetermined amount and illustrated by a solid line in the same drawing. On the other hand, when the electric motor 96 is driven to rotate reverse, the second rib 84 moves from the protruded state illustrated by the solid line in FIG. 10 to the retracted state illustrated by the two-dot chain line in the same drawing.

As illustrated in FIG. 11, when the first rib 83 is in the protruded state, the second rib 84 is in the retracted state. When the first rib 83 is in the protruded state, on the medium 12 illustrated by a two-dot chain line in FIG. 11 and received on the stacking surface 32A, a curl extending in the first direction Y1, which is an extending direction of the first rib 83, is formed at a portion pushed up by the first rib 83. In addition, as illustrated in FIG. 12, when the second rib 84 is in the protruded state, the first rib 83 is in the retracted state. In the state illustrated in FIG. 12, on the medium 12 illustrated by a two-dot chain line in FIG. 12 and received on the stacking surface 32A, a curl with tension extending in the width direction X, which is an extending direction of the second rib 84, is formed at a portion pushed up by the second rib 84. The extending direction of the first rib 83 may not necessarily coincide with the first direction Y1 as long as the curl extending in the first direction Y1 can be formed. Similarly, the extending direction of the second rib 84 may not necessarily coincide with the width direction X as long as the curl extending in the width direction X can be formed.

The medium stacking device 31 includes a first alignment mode aligning by the first alignment member 38 in a state where the curl extending in the first direction Y1 is generated on the medium 12 by the first rib 83 in the protruded state, and a second alignment mode aligning by the second alignment member 54 in a state where the curl extending in the width direction X is generated on the medium 12 by the second rib 84 in the protruded state.

The first curl forming mechanism 81 may include a pair of medium support portions 37, instead of or in addition to the configuration in which the first rib 83 is moved between the protruded state and the retracted state. In this case, the pair of medium support portions 37 moves in the width direction X to forcibly generate a curl C1 extending in the first direction Y1 on the medium 12 on the intermediate stacker 32 (refer to FIGS. 24 and 25). Alternatively, the medium support portion 37 is configured to be rotatable around the axis along the first direction Y1, in addition to the configuration movable in the width direction X. The medium support portion 37 forcibly generates the curl C1 extending in the first direction Y1 on the medium 12 on the intermediate stacker 32 by rotating around the axis (refer to FIGS. 26 and 27).

Furthermore, the medium support portion 37 is configured to be movable up and down in addition to the configuration movable in the width direction X. The first curl forming mechanism 81 forcibly generates the curl C1 extending in the first direction Y1 on the medium 12 on the intermediate stacker 32 by raising the medium support portion 37 (refer to FIG. 28), instead of or in addition to the configuration in which the first rib 83 is moved between the protruded state and the retracted state. In addition, the second curl forming mechanism 82 forcibly generates a curl C2 extending in the width direction X on the medium 12 on the intermediate stacker 32 by lowering the medium support portion 37 (refer to FIG. 29), instead of or in addition to the configuration in which the second rib 84 is moved between the protruded state and the retracted state.

Next, the electrical configuration of the medium treatment system 11 will be described with reference to FIG. 13.

Figure 13:
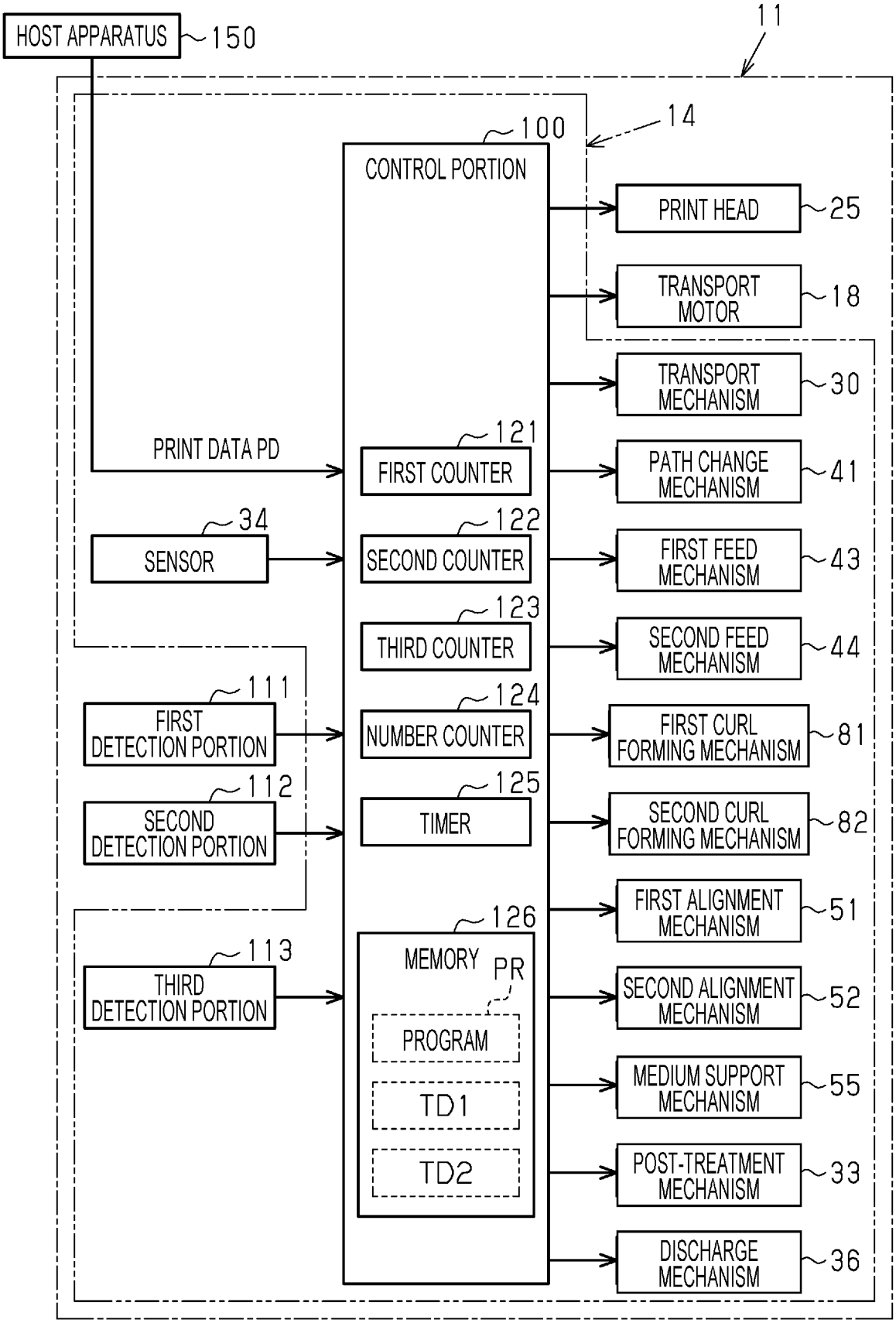
FIG. 13 is a block diagram illustrating an electrical configuration of the medium treatment system.

As illustrated in FIG. 13, the medium treatment system 11 is provided with a control portion 100 that comprehensively controls driving of each mechanism in the medium treatment system 11. For example, the control portion 100 receives print data PD from a host device 150. The print data PD includes printing condition information and, for example, CMYK color system image data that defines print contents.

The printing condition information includes information regarding a medium size, a medium type, presence or absence of double-sided printing (single-sided printing or double-sided printing), printing colors (color or gray scale), printing quality (normal printing or high-definition printing), number of printed sheets, and post-treatment condition information. Therefore, the control portion 100 can acquire the medium size, the medium type, information on single-sided printing or double-sided printing, post-treatment contents, and the number of media for one post-treatment, regarding the medium 12 to be post-treated by the post-treatment apparatus 14, from the printing condition information. Furthermore, the control portion 100 analyzes the amount of liquid adhering to each of the first surface and the second surface of the medium 12 in the double-sided printing based on the image data. In addition, based on the pixel values in the image data, the control portion 100 obtains a liquid ejection amount that the print head 25 ejects onto the medium 12, and divides this liquid ejection amount by the area of the medium 12 to acquire a printing duty in which an average ejection amount that is a liquid ejection amount per unit area is represented by a numerical value (%). The printing duty is indicated by a ratio (%) of the ejection amount when the maximum ejection amount is 100%.

The sensor 34, the first detection portion 111, the second detection portion 112, and the third detection portion 113 are electrically coupled to the control portion 100. The sensor 34 detects the presence or absence of the medium 12 and outputs a detection signal. The control portion 100 detects the leading edge 12*f* of the medium 12 by switching from a non-detection state where the sensor 34 does not detect the medium 12 to a detection state where the medium 12 is detected. In addition, the control portion 100 detects the trailing edge 12*r* of the medium 12 by switching from a detection state where the sensor 34 detects the medium 12 to a non-detection state where the medium 12 is not detected.

The first detection portion 111 may detect a medium thickness that is the thickness of the medium 12. In that case, the first detection portion 111 may be a contact sensor that detects the medium thickness by contacting the medium 12 or may be a non-contact sensor that detects the medium thickness in a non-contact manner using light or ultrasonic waves. When the first detection portion 111 is the contact sensor, for example, the first detection portion 111 detects a medium thickness from a difference between a reference detection position when a contactor that can be displaced in the thickness direction of the medium 12 is provided, and the contactor contacts the transport surface when the medium 12 is not present, and a detection position when the contactor contacts the surface of the medium 12.

The second detection portion 112 may detect a fiber direction of the medium 12. In that case, the second detection portion 112 may be, for example, a non-contact sensor such as an optical sensor that optically detects the fiber direction of the medium 12, or may include an image element that detects the fiber direction by performing an image treatment on a photographic image obtained by imaging the medium 12 at a high magnification. Examples of the optical sensor include a method of determining the fiber direction by irradiating the cellulose fiber on the surface of the medium with light and detecting a direction where the reflected light spreads.

The third detection portion 113 may detect a curl amount. In that case, the third detection portion 113 may be a contact sensor that detects a curl amount of the uppermost one of the media 12 stacked on the stacking surface 32A, or may be a non-contact sensor that detects a curl amount in a non-contact manner using light or ultrasonic waves. When the third detection portion 113 is the contact sensor, for example, a contactor that can be displaced in a direction intersecting the stacking surface 32A is provided, and a difference between a detection position when the contactor contacts the medium 12, and a calculated surface position of the uppermost one of the media 12 stacked on the stacking surface 32A at that time is detected as a curl amount.

As illustrated in FIG. 13, the control portion 100 transmits a control signal to the print head 25, the transport motor 18, the transport mechanism 30, the path change mechanism 41, the first feed mechanism 43, the second feed mechanism 44, the first curl forming mechanism 81, the second curl forming mechanism 82, the first alignment mechanism 51, the second alignment mechanism 52, the medium support mechanism 55, the post-treatment mechanism 33, and the discharge mechanism 36. As a result, the control portion 100 controls the operations of the print head 25, the transport motor 18, and each of the mechanisms 30, 33, 36, 41, 43, 44, 51, 52, 55, 81, and 82.

In addition, the control portion 100 is provided with a computer (not illustrated), and is provided with a first counter 121, a second counter 122, a third counter 123, a number counter 124, and a timer 125 in the computer. The timer 125 clocks an elapsed time after the sensor 34 detects the trailing edge 12*r* of the medium 12. The control portion 100 controls a drive start timing of the movable guide 42, the first alignment member 38, the second alignment member 54, and the like according to the elapsed time clocked by the timer 125. When the elapsed time clocked by the timer 125 reaches a first predetermined time T01, the control portion 100 drives the drive source of the path change mechanism 41 to move the movable guide 42 from the retracted position to the operating position, so that the path of the medium 12 is changed. When the elapsed time reaches a second predetermined time T02, the control portion 100 returns the movable guide 42 to the original retracted position. In addition, when the elapsed time clocked by the timer 125 reaches a first specified time T1, the control portion 100 drives the electric motor 62 to start a first alignment operation by the first alignment member 38. When the elapsed time clocked by the timer 125 reaches a second specified time T2, the control portion 100 drives the electric motor 72 to start a second alignment operation by the second alignment member 54.

In addition, the first counter 121 counts a count value indicating a position of the first alignment member 38 on the movement path by counting the number of pulses of a detection signal input from an encoder (not illustrated) that detects the rotation of the electric motor 62 as the drive source of the first alignment mechanism 51. The control portion 100 moves the first alignment member 38 to stop at each position from the first position P1 to the third position P3, by controlling the electric motor 62 based on the position of the first alignment member 38 grasped from the count value of the first counter 121.

The second counter 122 counts a count value indicating a position of the second alignment member 54 on the movement path by counting the number of pulses of a detection signal input from an encoder (not illustrated) that detects the rotation of the electric motor 72 as the drive source of the second alignment mechanism 52. The control portion 100 moves the second alignment member 54 to stop at each position of the retracted position and the alignment position, by controlling the electric motor 72 based on the position of the second alignment member 54 grasped from the count value of the second counter 122. The retreat position and the alignment position are determined according to the width of the medium 12. The retracted positions are positions outer sides further than the side edges on both sides of the medium 12 in the width direction by a predetermined distance. The alignment position is a position in contact with the side edges on both sides of the medium 12 in the width direction.

The third counter 123 counts a count value indicating a position of the medium support portion 37 on the movement path in the width direction X by counting the number of pulses of a detection signal input from encoders (all are not illustrated) that detect the rotation of the electric motor as the drive source of the medium support portion 37. The control portion 100 stops the pair of medium support portions 37 at the guide position and the retracted position by controlling the electric motor based on the position of the medium support portion 37 grasped from the count value of the third counter 123.

In addition, the number counter 124 counts the number of media 12 stacked on the intermediate stacker 32. The control portion 100 determines whether or not the number of stacked media 12 is reached a target number of sheets with reference to the count value of the number counter 124.

The control portion 100 includes, for example, a CPU and a memory 126 (not illustrated), and performs various treatment operations when the CPU executes various programs stored in the memory 126. The memory 126 stores a post-treatment control program PR illustrated in the flowchart of FIG. 16. The CPU performs a post-treatment control of the post-treatment apparatus 14 by executing the post-treatment control program PR. This post-treatment control includes medium stacking control on the intermediate stacker 32, drive control of the post-treatment mechanism 33, discharge control of the media bundle 12B after the post-treatment, and the like.

When aligning the medium 12 received on the intermediate stacker 32, the control portion 100 performs first control that normally forms a curl with a predetermined curl amount on the medium 12. In addition, the control portion 100 can also perform second control that in which the presence or absence of the curl forming operation is individually determined for each alignment direction, or the curl amount during the curl forming operation is individually determined for each alignment direction, based on the printing condition information and the detection result information of each of the detection portions 111 to 113. The memory 126 stores first reference data TD1 and second reference data TD2 illustrated in FIGS. 14 and 15, which are referred to when the CPU performs the second control in the curl forming operation in the medium stacking control. The control portion 100 refers to the reference data TD1 and TD2 in the curl forming operation performed by controlling the first curl forming mechanism 81 and the second curl forming mechanism 82 in the second control.

The first reference data TD1 is referred to when the second control is performed using the first rib 83 and the second rib 84. The control portion 100 individually determines whether or not the first rib 83 and the second rib 84 are protruded, and individually determines the protrusion amount of the first rib 83 and the second rib 84, by referring to the first reference data TD1 based on the printing condition information and the detection result information of each of the detection portions 111 to 113.

The second reference data TD2 is referred to when the second control is performed as a configuration using the pair of medium support portions 37 as the deformation forming portions. The control portion 100 determines the operation of the pair of medium support portions 37 by referring to the second reference data TD2 based on the printing condition information and the detection result information of each of the detection portions 111 to 113.

Next, the operation of the medium treatment system 11 will be described.

The control portion 100 of the medium treatment system 11 receives print data PD from a host device 150. The print data PD includes printing condition information and print image data. The control portion 100 acquires information such as a medium size, a medium type, printing colors (color or gray scale), printing quality (normal printing or high-definition printing), number of printed sheets, and post-treatment condition information included in the printing condition information. The post-treatment condition information includes post-treatment contents including the post-treatment position and the type of post-treatment, the number of media to be post-treated once, and the like. The control portion 100 performs print control for printing an image based on the image data on the medium 12 according to the printing condition information. The control portion 100 controls the transport motor 18 to transport the medium 12 along the transport path 17, and performs ejection control of the print head 25 based on the print image data in the printing apparatus 13 in the middle of the transport path 17. The print head 25 prints on the medium 12 by ejecting the liquid. The medium 12 after printing is sent to the intermediate apparatus 15 along the transport path 17, is reversed by the reversing treatment portion 200 in the intermediate apparatus 15, and thereafter is discharged from the intermediate apparatus 15 to the post-treatment apparatus 14. In this manner, the medium 12 is sequentially carried into the post-treatment apparatus 14 in such a direction that the immediately preceding printing surface is the lower surface. In the post-treatment apparatus 14, the medium 12 reversed by the reversing treatment portion 200 and discharged is transported by the transport mechanism 30, and sequentially discharged from the transport roller pair 19B in the first transport direction Y0.

In some cases, the medium 12 after printing absorbs water contained in the attached liquid and the cellulose fibers and the like are elongated to generate a curl. The curl grows in the process in which the cellulose fibers absorb water and stretch, and as the liquid attached to the medium 12 dries, elongation of the cellulose fibers and the like is reduced, thereby reducing the curl. Since the liquid attached to the medium 12 is dried while the medium 12 after printing is transported through the intermediate apparatus 15, the curl is reduced as the drying proceeds. When the amount of liquid ejected to the medium 12 is large, a large curl may still remain when the medium 12 is carried into the post-treatment apparatus 14. In addition, since the direction where the curl is generated on the medium 12 depends on the fiber direction of the medium 12, a curl that curves in the first direction Y1 may occur, or a curl that curves in the width direction X may occur. In addition, since the direction where the medium 12 curls depends on the difference in elongation between the front surface and the rear surface when water contained in the attached liquid is absorbed, in some cases, the curl is curved upward, and in other cases, the curl is curved downward. This type of curl causes alignment to be hindered, for example, the edge portion of the medium 12 is simply curved and cannot be aligned, even if the leading edge 12*f* or the side edge 12*s* of the medium 12 received on the intermediate stacker 32 is pressed with the alignment surface by the first alignment member 38 and the second alignment member 54.

Figure 16:
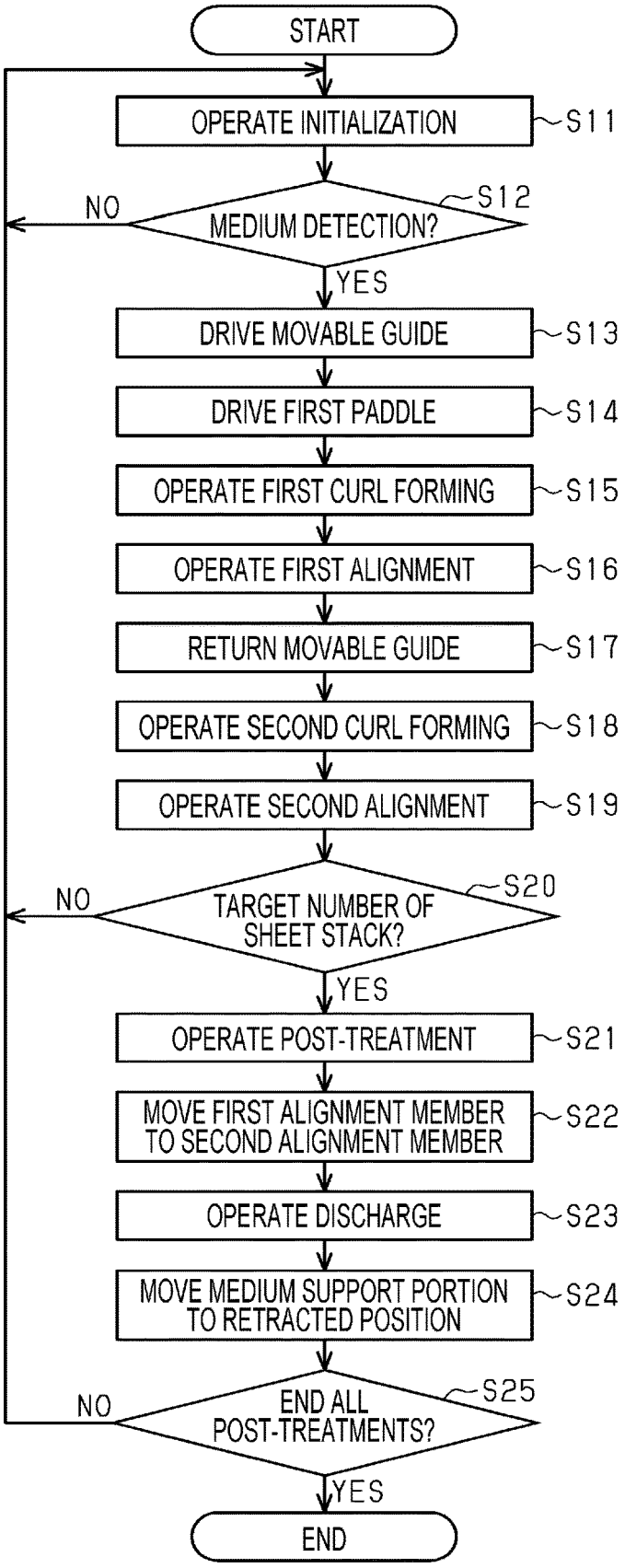
FIG. 16 is a flowchart illustrating a post-treatment control.

In the post-treatment apparatus 14, the control portion 100 executes the program PR illustrated in FIG. 16 to perform the post-treatment control. Hereinafter, the post-treatment control executed by the control portion 100 will be described with reference to FIG. 16. In the following, an example in which the curl forming operation is performed by the first control will be described first, and an example in which the curl forming operation is performed by the second control will be described later. In addition, an example in which a plurality of media 12 are stacked on the intermediate stacker 32 and the post-treatment is performed on a bundle of the stacked media 12 will be described.

First, in step S11, the control portion 100 performs an initialization operation of the medium stacking device 31. That is, the control portion 100 normally rotates the transport roller pairs 19A and 19B and normally rotates the second paddle 46. In addition, the control portion 100 disposes the movable guide 42 at the retracted position, the medium support portion 37 at the support position, the first alignment member 38 at the third position P3, the second alignment member 54 at the retracted position, the first paddle 45 at the retracted position, the first rib 83 at the retracted state, and the second rib 84 at the retracted state, respectively. Here, when the pair of medium support portions 37 is at the support position, the distance between the pair of guide surfaces 37B facing each other is slightly wider than the width of the medium 12. In addition, when the pair of second alignment members 54 is at the guide position, the distance between the pair of alignment surfaces 54A facing each other is slightly wider than the width of the medium 12.

In step S12, the control portion 100 determines whether or not the sensor 34 detects the trailing edge 12*r* of the medium 12. When the sensor 34 does not detect the trailing edge 12*r* of the medium 12, the control portion 100 stands by as it is, and when the sensor 34 detects the trailing edge 12*r* of the medium 12, the control portion 100 proceeds to step S13.

Figure 17:
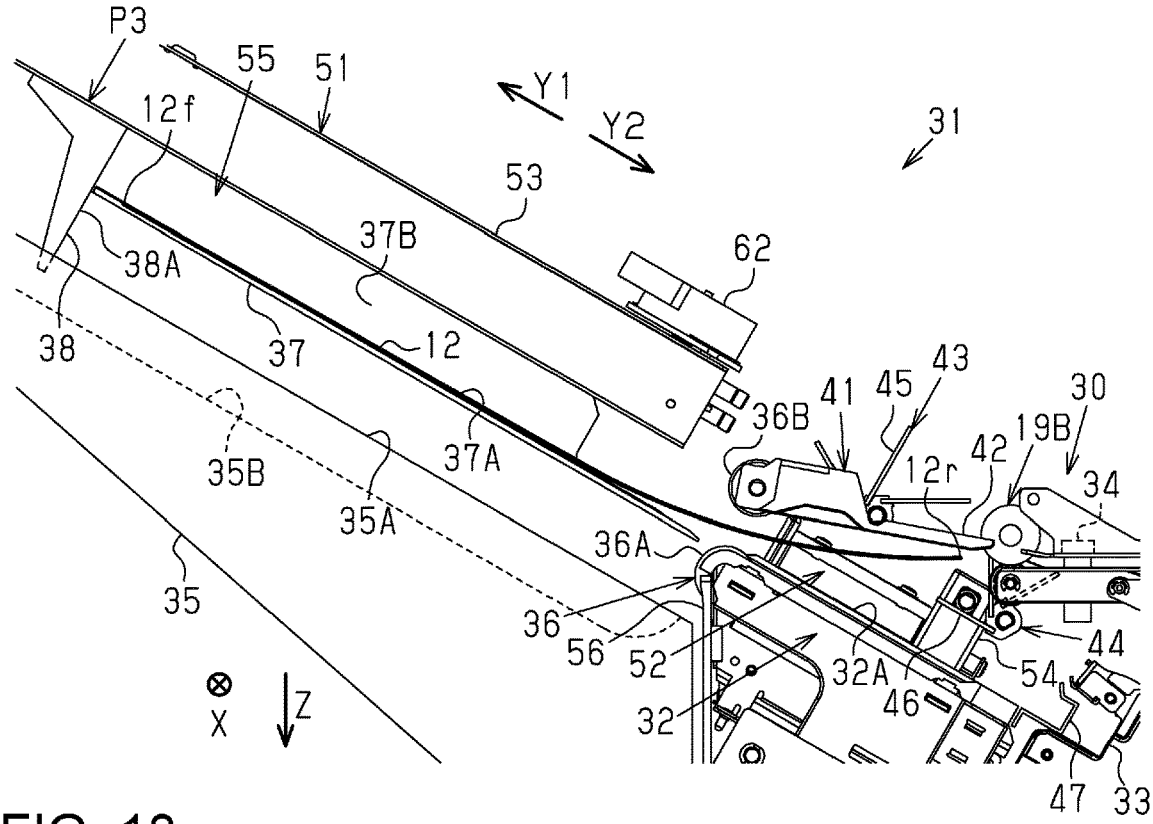
FIG. 17 is a partial side view illustrating an aspect that a medium is discharged to an intermediate stacker in the medium stacking device.
Figure 18:
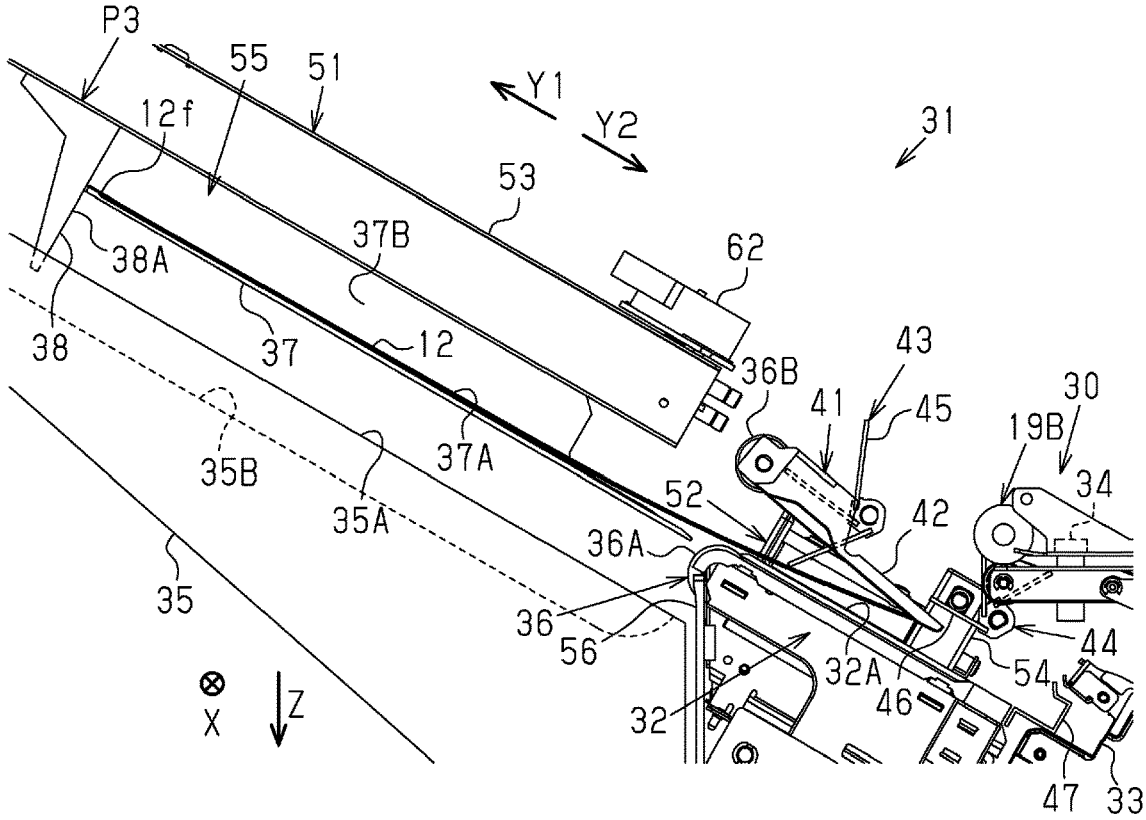
FIG. 18 is a partial side view illustrating an aspect that a discharge path of the medium is changed in the medium stacking device.

In step S13, the control portion 100 drives the movable guide 42. Specifically, when a clocked time by the timer 125, when clocking starts from a time when the sensor 34 detects the trailing edge 12*r* of the medium 12, reaches a first predetermined time T01, the control portion 100 drives the drive source of the path change mechanism 41 to rotate the movable guide 42 from the retracted position illustrated in FIG. 17 to the operating position illustrated in FIG. 18. As a result, at the timing when the trailing edge 12*r* of the medium 12 is discharged from the transport roller pair 19B, the movable guide 42 rotates from the retracted position to the operating position, and knocks down the trailing edge portion of the medium 12 as illustrated in FIG. 18. As a result, the path along the first transport direction Y0 of the medium 12 discharged from the transport roller pair 19B at a predetermined discharge speed is changed to an oblique path along the stacking surface 32A of the intermediate stacker 32. As a result, the medium 12 is received on the intermediate stacker 32.

In step S14, the control portion 100 rotates the first paddle 45 once. As a result, the medium 12 knocked down on the intermediate stacker 32 is pulled back in the second direction Y2 by the first paddle 45. In this example, the rotation start timing of the first paddle 45 is substantially the same as the rotation start timing of the movable guide 42 from the retracted position to the operating position. Therefore, for the medium 12 having a large size, the first paddle 45 knocks down the medium 12 with the blade 45A and a transport force to be sent in the second direction Y2 is applied to the medium 12 (refer to FIG. 18). The transport force that pulls the medium 12 back in the second direction Y2 while the first paddle 45 knocks down the medium 12 acts as a braking force against the inertial force that the medium 12 tries to move in the first transport direction Y0 when discharged. Therefore, the movement of the medium 12 in the first direction Y1 is suppressed to some extent, and the leading edge 12*f* of the medium 12 does not contact the alignment surface 38A of the first alignment member 38 at the third position P3. However, when the medium 12 moves too much in the first direction Y1 for some reason, the leading edge 12*f* of the medium 12 strikes the alignment surface 38A of the first alignment member 38 at the third position P3, so that the arrival position of the medium 12 in the first direction Y1 is defined to some extent.

When the medium 12 received on the stacking surface 32A of the intermediate stacker 32 is transported in the second direction Y2 to the predetermined position by the first paddle 45, the medium 12 is then sent in the second direction Y2 by the second paddle 46. The medium 12 having a small size is relatively light in weight and has a small inertial force in the discharge direction. Therefore, the moving speed in the discharge direction is suppressed to some extent by the braking force applied to the medium 12 when the transport path is changed by being struck by the movable guide 42. The medium 12 having a small size is sent in the second direction Y2 by the second paddle 46. In this manner, the medium 12 is pulled back until the trailing edge 12*r* abuts against the medium abutment portion 47. When the trailing edge 12*r* abuts against the medium abutment portion 47, the medium 12 is positioned in the first direction Y1 with respect to the medium abutment portion 47. In the present embodiment, the treatments in steps S13 and S14 correspond to an example of "receiving the medium by the intermediate stacking portion after being treated by the treatment portion".

Figure 19:
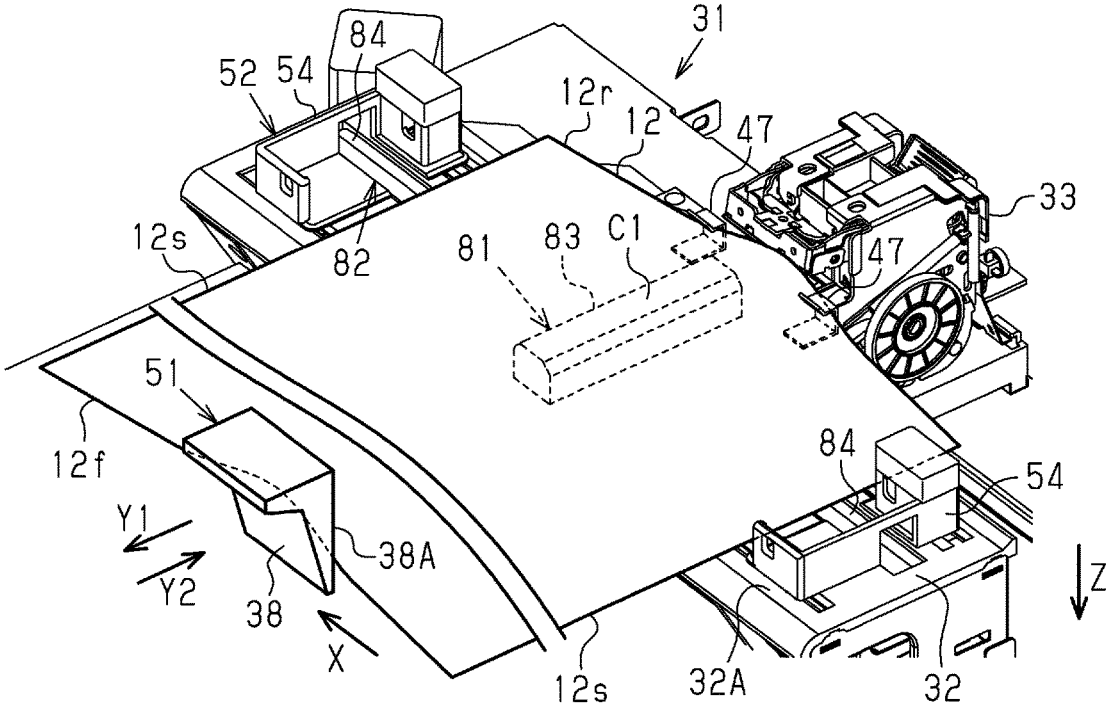
FIG. 19 is a perspective view illustrating an aspect that a curl extending in a transport direction is formed on the medium by protruding the first rib.

In step S15, the control portion 100 performs a first curl forming operation. That is, the control portion 100 controls the electric motor 89 to raise the first rib 83 from the retracted state to the protruded state. As a result, the first rib 83 is disposed in the protruded state and the second rib 84 is disposed in the retracted state (refer to FIG. 11). As illustrated in FIG. 19, as a result of the first curl forming operation in which the first rib 83 extending in the first direction Y1 protrudes from the stacking surface 32A under the state where the medium 12 is received on the stacking surface 32A, the curl C1 extending in the first direction Y1 is forcibly formed on the medium 12. As illustrated by a solid line in FIG. 20, the curl C1 that is forcibly formed on the medium 12 causes the medium 12 to be stiff in the first direction Y1.

In step S16, the control portion 100 performs a first alignment operation. When the time clocked by the timer 125 reaches the first specified time T1, the control portion 100 controls the electric motor 62 to reciprocate the first alignment member 38 from the third position P3, which is the retracted position during medium stacking, to the first position P1, which is the alignment position. At this time, the first alignment member 38 strikes the leading edge 12*f* of the medium 12 one or more times, and the trailing edge 12*r* of the medium 12 strikes the medium abutment portion 47, and thus the medium 12 is aligned in the first direction Y1. In this manner, the first alignment mode is performed in which alignment is performed by the first alignment member 38 in a state where the curl C1 extending in the first direction Y1 is generated on the medium 12 by the first curl forming mechanism 81. That is, in the first alignment mode, the medium 12 is aligned in the first direction Y1 by the first alignment member 38 in a state where the curl C1 extending in the first direction Y1 is generated on the medium 12 by the first curl forming mechanism 81. When the first alignment operation is started, the first paddle 45 is completed one rotation and is in the retracted position.

Figure 20:
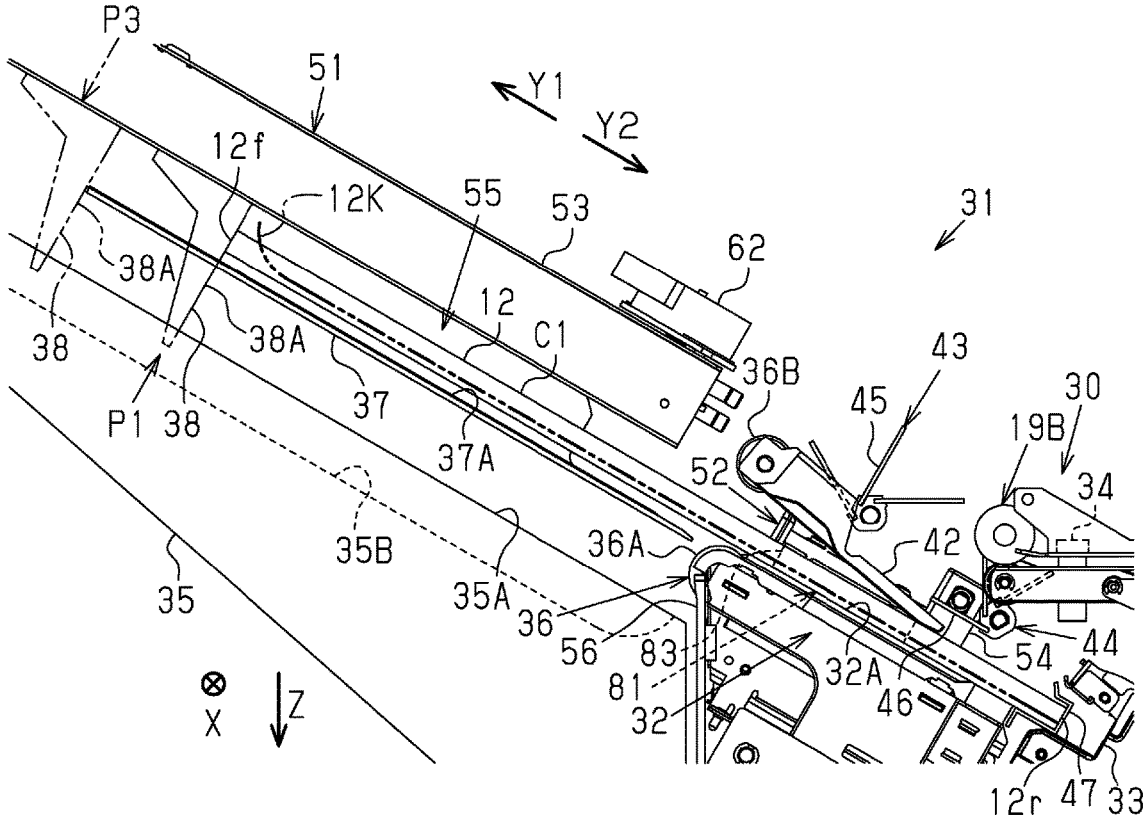
FIG. 20 is a side view illustrating an aspect that the curl extending in the transport direction is formed on the medium by protruding the first rib.

As a result, as illustrated in FIGS. 19 and 20, the first alignment member 38 strikes the leading edge 12*f* in the first direction Y1 of the medium 12 that is stiff in the first direction Y1 with the alignment surface 38A so that the medium 12 is aligned in the first direction Y1. At this time, when both end portions of the first direction Y1 are curled by the influence of liquid moisture as in the medium 12K of the comparative example illustrated by the two-dot chain line in FIG. 20, even if the first alignment member 38 is moved to the first position P1, the medium 12 cannot be aligned in the first direction Y1 simply by bending the curled end portion of the medium 12. On the other hand, in the present embodiment, the curl C1 extending in the first direction Y1 is forcibly formed by the first rib 83 protruding from the stacking surface 32A as in the medium 12 illustrated by the solid line in FIG. 20. Therefore, the medium 12 is aligned in the first direction Y1 by moving the first alignment member 38 to the first position P1 and striking the leading edge 12*f* of the medium 12 by the alignment surface 38A one or more times. At this time, the movable guide 42 is in the operating position lowered to a height that does not hinder the first curl forming operation due to the raising of the first rib 83, and has a function of pressing the end portion of the medium 12 that is excessively lifted. In the present embodiment, the treatment in step S16 corresponds to an example of "moving the contact portion to the first position and aligning the medium on the intermediate stacking portion in the transport direction".

In step S17, the control portion 100 returns the movable guide 42. The control portion 100 returns the movable guide 42 from the operating position to the retracted position when the second predetermined time T02 is elapsed since the sensor 34 detects the trailing edge 12*r* of the medium 12.

Figure 21:
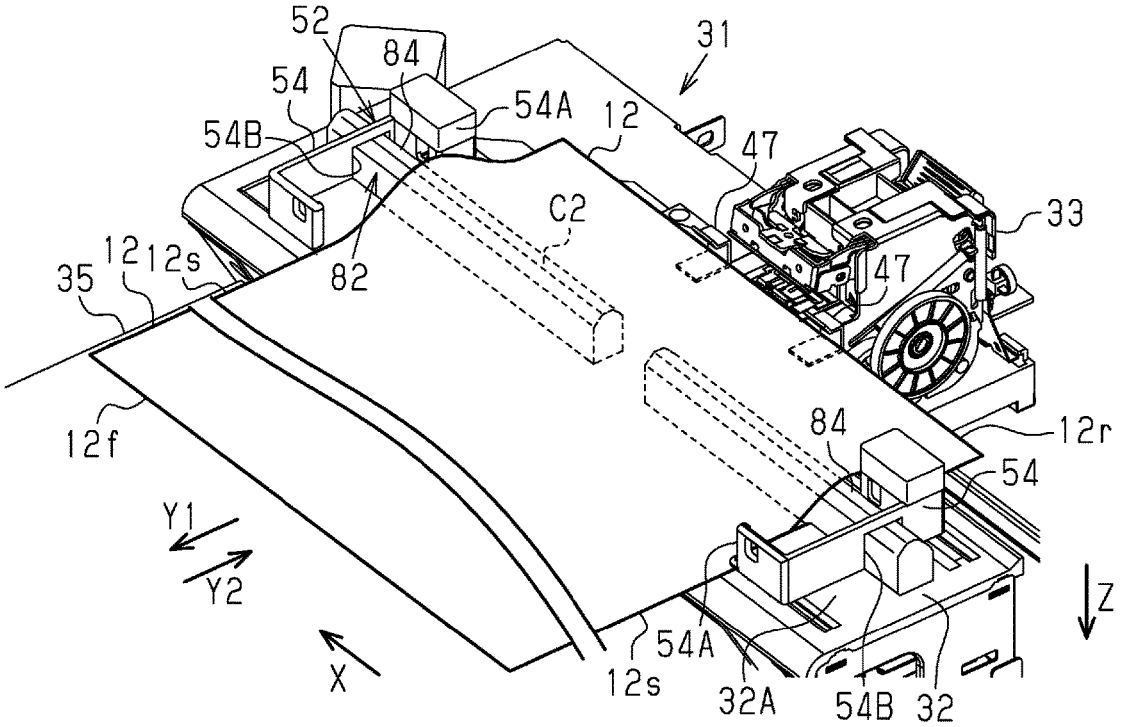
FIG. 21 is a perspective view illustrating an aspect that the curl extending in a width direction is formed on the medium by protruding the second rib.

In step S18, the control portion 100 performs a second curl forming operation. That is, the control portion 100 controls the electric motor 89 to lower the first rib 83 from the protruded state to the retracted state, and controls the electric motor 96 to raise the second rib 84 from the retracted state to the protruded state (refer to FIG. 12). As illustrated in FIG. 21, as a result of the second curl forming operation in which the second rib 84 extending in the width direction X protrudes from the stacking surface 32A under the state where the medium 12 is received on the stacking surface 32A, the curl C2 extending in the width direction X is forcibly formed on the medium 12. As illustrated by a solid line in FIG. 22, the curl C2 forcibly formed on the medium 12 and extending in the width direction X causes the medium 12 to be stiff in the width direction X.

Figure 22:
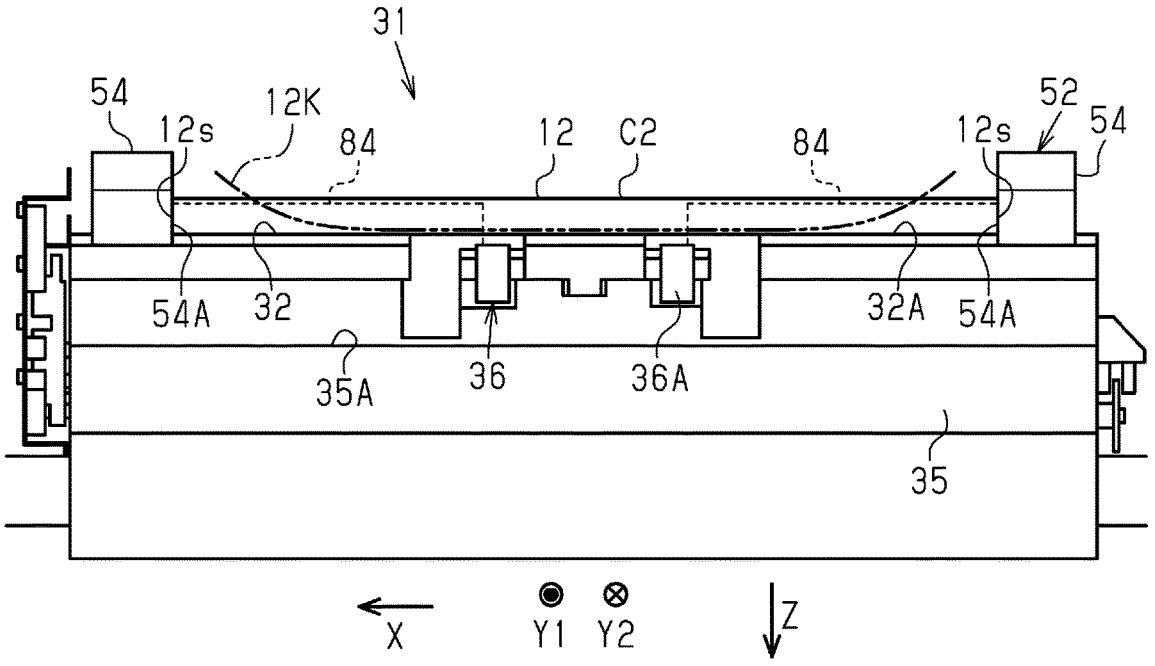
FIG. 22 is a front view illustrating an aspect that the curl extending in the width direction is formed on the medium by protruding the second rib, as viewed from a direction along a first direction.

In step S19, the control portion 100 performs a second alignment operation. The control portion 100 controls the electric motor 72 to reciprocate the pair of second alignment members 54 between the retracted position positioned at a slightly larger interval than the medium width and the alignment position positioned at the same interval as the medium width. As a result, as illustrated in FIGS. 21 and 22, the pair of second alignment members 54 strikes both side edges 12*s* in the width direction X of the medium 12 that is stiff in the width direction X with the pair of alignment surfaces 54A, so that the medium 12 is aligned in the width direction X. In this manner, in a state where the curl C2 extending in the width direction X is generated on the medium 12 by the second curl forming mechanism 82, the second alignment mode is performed in which the pair of second alignment members 54 strikes the both side edges 12*s* of the medium 12 one or more times so as to interpose the medium 12 in the width direction X.

At this time, when both end portions in the width direction X are curled by the influence of liquid moisture as in the medium 12K of the comparative example illustrated by the two-dot chain line in FIG. 22, even if the medium 12K is interposed in the width direction X by the pair of second alignment members 54, the medium 12 cannot be aligned in the width direction X simply by bending the curled end portion of the medium 12. On the other hand, the curl C2 extending in the width direction X is forcibly formed by the second rib 84 protruding from the stacking surface 32A as in the medium 12 illustrated by the solid line in FIG. 22. Therefore, the medium 12 is aligned in the width direction X by striking the side edges 12*s* of the medium 12 by the pair of alignment surfaces 54A with the pair of second alignment members 54 interposing the medium 12 in the width direction X.

In this manner, the medium 12 is aligned on the intermediate stacker 32 in the two directions of the first direction Y1 and the width direction X. When the second alignment operation is completed, the control portion 100 controls the electric motor 96 to lower the second rib 84 from the protruded state to the retracted state. As a result, both the first rib 83 and the second rib 84 are disposed in the retracted state. Here, during the first alignment operation and the second alignment operation, the second paddle 46 may be temporarily stopped at the retracted position illustrated in FIGS. 2 and 6 that does not hinder the alignment operation. In addition, after the second alignment operation is completed, until the next medium 12 is received on the intermediate stacker 32, the second paddle 46 is brought into contact with the medium 12 on the stacking surface 32A and stopped in a deformed state. Therefore, the aligned medium 12 may be pressed by the second paddle 46 so that the aligned state does not shift. In addition, when the second paddle 46 is normally rotated, control may be performed such that the second alignment member 54 is moved to the alignment position at a timing at which the blade 46A does not contact the medium 12 at the interval at which the blade 46A of the second paddle 46 intermittently contacts the medium 12.

In step S20, the control portion 100 determines whether or not a target number of sheets of media 12 are stacked on the intermediate stacker 32. If the target number of sheets is stacked, the treatment proceeds to step S21. If the target number of sheets is not stacked, the treatment returns to step S12. Thereafter, the control portion 100 repeats the treatment from step S12 to step S20 each time one medium 12 is carried from the reversing treatment portion 200 until it is determined in step S20 that the target number of sheets is stacked. If the control portion 100 determines in step S20 that the target number of sheets is stacked, the treatment proceeds to step S21.

In step S21, the control portion 100 performs a post-treatment operation. The control portion 100 drives the post-treatment mechanism 33 to perform the post-treatment on the aligned media bundle 12B on the stacking surface 32A. In the present embodiment, the control portion 100 drives the post-treatment mechanism 33 to perform the post-treatment of binding the media bundle 12B on the intermediate stacker 32. For example, when a stapling treatment is instructed by specifying a binding position as the post-treatment, the control portion 100 moves the post-treatment mechanism 33 in the width direction X along the guide groove 39A and performs the stapling operation of driving the post-treatment mechanism 33 at a predetermined position at the trailing edge portion of the media bundle 12B one or more times. Therefore, the trailing edge portion of the media bundle 12B is bound at one or more places. In addition, when the oblique post-treatment is performed, for the media bundle 12B having a size less than the maximum size, the media bundle 12B is moved in the width direction X until the trailing edge corner portion of the media bundle 12B reaches an oblique treatment position when the post-treatment mechanism 33 performs an oblique post-treatment, while maintaining an interval in the width direction X between the pair of medium support portions 37 and the pair of second alignment members 54. The post-treatment mechanism 33 moved to the oblique treatment position is driven in an oblique posture, so that oblique strike is applied to the trailing edge corner portion of the media bundle 12B. Thereafter, the media bundle 12B is returned to the original position where the width center of the media bundle 12B and the width center of the medium stacking area of the intermediate stacker 32 coincide with each other in the width direction X, while the pair of medium support portions 37 and the pair of second alignment members 54 are maintained with an interval in the width direction X. In addition, each time the target number of sheets is stacked, the second paddle 46 is temporarily stopped at the retracted position illustrated in FIGS. 2 and 6, so that the post-treatment operation by the post-treatment mechanism 33 and the subsequent discharge operation by the discharge mechanism 36 are not hindered. In the present embodiment, the treatment in step S21 corresponds to an example of "performing the post-treatment on the medium after aligning the medium on the intermediate stacking portion".

In step S22, the control portion 100 moves the first alignment member 38 to the second position P2. That is, the control portion 100 drives the electric motor 62 as a drive source of the first alignment mechanism 51 to move the first alignment member 38 from the third position P3 to the second position P2. In this manner, the control portion 100 moves the first alignment member 38 to the second position P2 separated further from the leading edge 12*f* of the medium 12 than is the first position P1. The treatment of step S22 is preferably performed in parallel during the post-treatment operation of step S21, and may be performed after the post-treatment operation is completed. In the present embodiment, the treatment of step S22 corresponds to an example of "moving the contact portion to the second position that is separated further from the leading edge of the medium than is the first position".

In step S23, the control portion 100 performs a discharge operation. That is, the control portion 100 causes the discharge mechanism 36 to discharge the media bundle 12B from the intermediate stacker 32 in the first direction Y1. Specifically, the driven roller 36B constituting the discharge mechanism 36 is moved from the separated position illustrated in FIGS. 5 and 20 to the nip position illustrated in FIGS. 6 and 23. Therefore, the media bundle 12B is nipped between the driving roller 36A and the driven roller 36B. The control portion 100 drives the discharge mechanism 36 at the timing after the nip, and discharges the media bundle 12B illustrated by a two-dot chain line in FIG. 6, nipped between the rollers 36A and 36B as illustrated in the same drawing from the intermediate stacker 32 in the first direction Y1.

Figure 23:
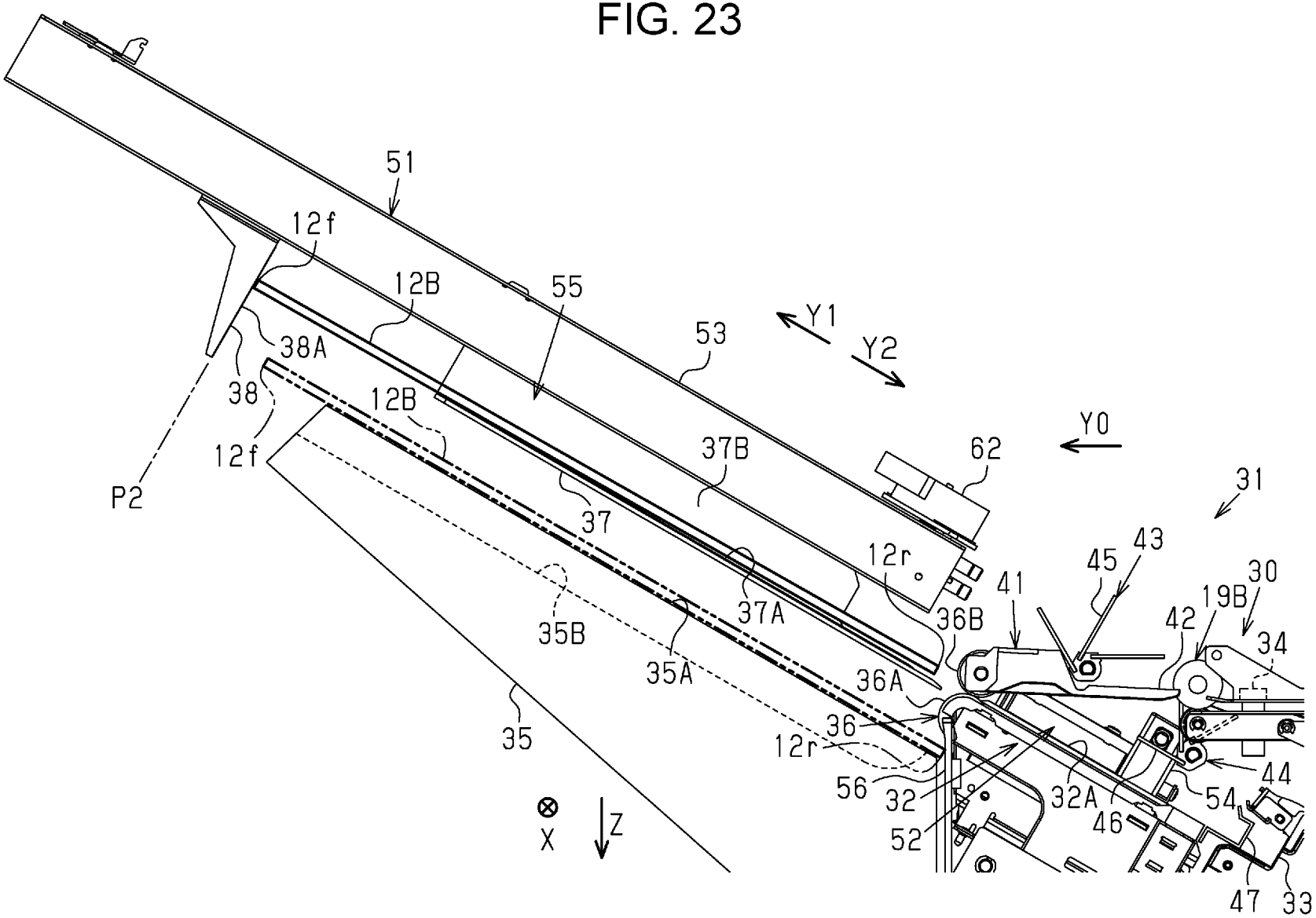
FIG. 23 is a side view illustrating an aspect that the media bundle is discharged from the intermediate stacker, and the medium stacking device and the periphery thereof.

As illustrated in FIG. 23, the medium 12 discharged from the intermediate stacker 32 in the first direction Y1 is restricted from being discharged further by the leading edge 12*f* of the medium 12 contacting the alignment surface 38A of the first alignment member 38 at the second position P2. That is, it is avoided that the discharged media bundle 12B is too far separated from the standing wall 56 in the first direction Y1. The reaching position of the discharged media bundle 12B in the first direction Y1 can be defined to some extent.

Here, the media bundle 12B is preferably discharged by the discharge mechanism 36 in a state where the pair of second alignment members 54 is left in the retracted position and the media bundle 12B is guided in the width direction X by the pair of alignment surfaces 54A. For example, the discharge mechanism 36 may be an extrusion method in which the media bundle 12B is extruded and discharged by an extrusion member such as a pusher instead of a roller method. In the configuration using the discharge mechanism 36 of the extrusion method, since the alignment state of the media bundle 12B may be shifted during the extrusion process of the media bundle 12B, compared to the roller method of nipping the media bundle 12B, it is desirable to guide the media bundle 12B in the width direction X by the pair of second alignment members 54. In the roller-type discharge mechanism 36 of this example, when discharging the media bundle 12B, the pair of second alignment members 54 may be moved further from the retracted position to a standby position outside in the first direction Y1. In the present embodiment, the treatment of step S23 corresponds to an example of "contacting the leading edge of the medium transported from the intermediate stacking portion with the contact portion at the second position".

In step S24, the control portion 100 moves the medium support portion 37 to the retracted position. The control portion 100 reciprocates the medium support portion 37 in the width direction X between the support position and the retracted position. At the timing when the trailing edge 12*r* of the media bundle 12B deviates from the nip position of the rollers 36A and 36B of the discharge mechanism 36, the medium support portion 37 is temporarily retreated to the retreat position. After the leading edge 12*f* of the media bundle 12B strikes the alignment surface 38A of the first alignment member 38, the media bundle 12B falls onto the stacking surface 35A of the discharge stacker 35 from the pair of medium support portions 37 moved to the retracted position. The dropped media bundle 12B slides down in the second direction Y2 on the stacking surface 35A or the upper surface of the preceding media bundle 12B previously stacked, and since the trailing edge 12*r* collides with the standing wall 56, the dropped media bundle 12B is aligned in the first direction Y1 with the position of the standing wall 56 as a reference. In the present embodiment, the treatment of step S24 corresponds to an example of "stacking portion stacks the medium brought into contact with the contact portion at the second position".

For example, when the media bundle 12B is not regulated by the first alignment member 38 during the discharge process, the medium 12 falls on the discharge stacker 35 at a position where the trailing edge 12*r* is further away from the standing wall 56 in the first direction Y1. In this case, a situation in which the trailing edge 12*r* cannot slide down to the position where the trailing edge 12*r* strikes the standing wall 56 is likely to occur due to the frictional resistance in the sliding process of the media bundle 12B. In this case, the alignment state of the media bundle 12B on the discharge stacker 35 is deteriorated. However, in the present embodiment, since the dropped position of the discharged media bundle 12B onto the discharge stacker 35 can be defined at a position closer to the standing wall 56 in the second direction Y2, the distance by which the dropped media bundle 12B slides down the stacking surface 35A until the trailing edge 12*r* abuts against the standing wall 56 is shortened, and the alignment of the media bundle 12B on the discharge stacker 35 is enhanced.

In step S25, the control portion 100 determines whether or not all the post-treatment is completed. When it is determined that all the post-treatment is completed, the routine ends. On the other hand, when all the post-treatment is not completed, that is, when the medium 12 to be post-treated remains, the treatment returns to step S12, and the treatments of steps S12 to S25 are repeated. When the post-treatment of the last media bundle 12B is completed and all the post-treatment is completed, the routine is completed.

As described above, in the present embodiment, the first curl forming mechanism 81 that performs the first curl forming operation in Step S15 and the second curl forming mechanism 82 that performs the second curl forming operation in Step S18 are configured using the ribs 83 and 84, respectively. Instead of the ribs 83 and 84, the pair of medium support portions 37 may be used. Hereinafter, the first curl forming operation and the second curl forming operation performed by the control portion 100 by driving and controlling the pair of medium support portions 37 will be described. First, an example of the first curl forming mechanism 81 that forcibly forms the curl C1 extending in the first direction Y1 as a deformation with tension extending in the first direction Y1 on the medium 12 received in intermediate stacker 32 using the pair of medium support portions 37 will be described.

Figure 24:
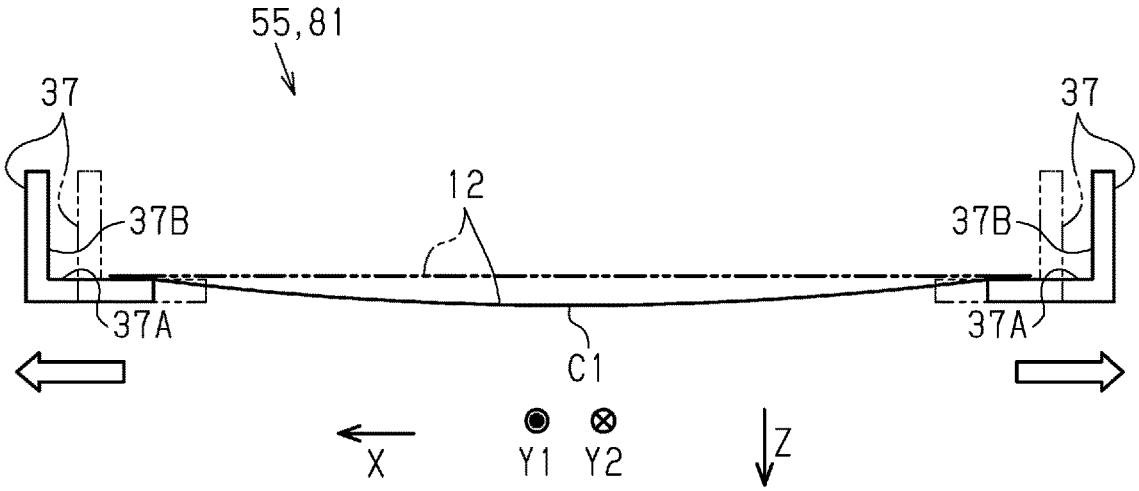
FIG. 24 is a schematic front view illustrating an example of the first curl forming mechanism by moving a pair of medium support portions in the width direction, as viewed from the direction along the first direction.
Figure 25:
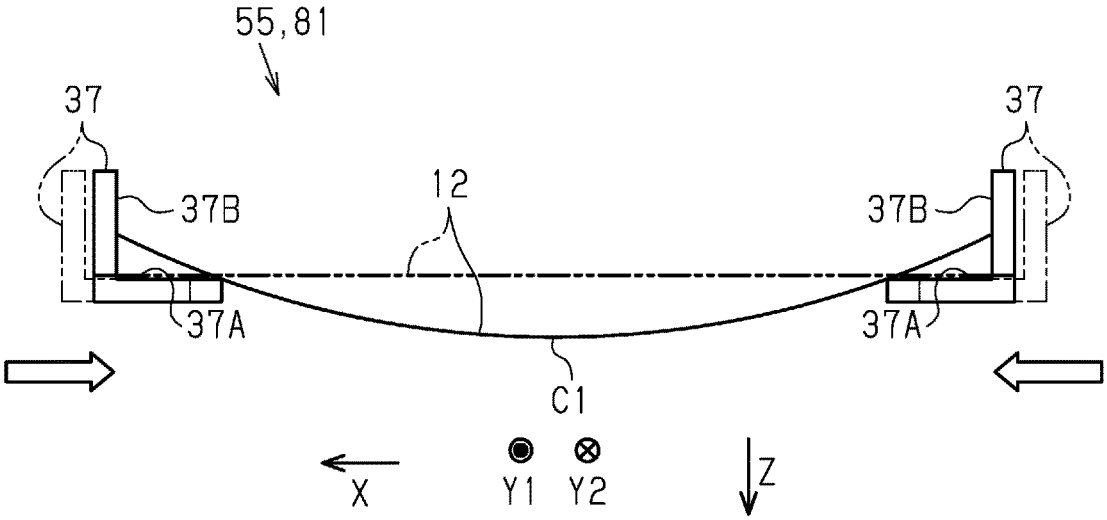
FIG. 25 is a schematic front view illustrating an example of the first curl forming mechanism by moving the pair of medium support portions in the width direction, as viewed from the direction along the first direction.

For example, as illustrated in FIGS. 24 and 25, the pair of medium support portions 37 is provided on both sides in the width direction and is movable in the width direction X. The curl C1 extending in the first direction Y1, as an example of the deformation with tension extending in the first direction Y1 is forcibly generated on the medium 12 by moving in the width direction X while supporting the leading edge portion of the medium 12 on the intermediate stacker 32 (refer to FIGS. 2 and 4). That is, as illustrated in FIG. 24, the pair of medium support portions 37 is moved from the support position illustrated by the two-dot chain line in the same drawing in a direction illustrated by white arrow in the same drawing in which the interval is widened in the width direction X, and the support location for supporting the medium 12 is moved outward in the width direction X, so that the center portion of the medium 12 hangs down under its own weight. By hanging-down the center portion of the medium 12 in a curved shape by its own weight, a downwardly protruded curl C1 extending in the first direction Y1 is positively formed. In the example illustrated in FIG. 24, the medium support portion 37 functions as the first curl forming mechanism 81 as an example of a first deformation forming portion that forms the curl C1 extending in the first direction Y1 on the medium 12.

In addition, as illustrated in FIG. 25, the pair of medium support portions 37 is moved from the support position illustrated by a two-dot chain line in the same drawing in the direction illustrated by the white arrow in the same drawing in which the interval is narrowed in the width direction X. As a result, the pair of medium support portions 37 applies a force to narrow the interval to both end portions in the width direction X of the medium 12 to bend the medium 12, so that a downwardly protruded curl C1 extending in the first direction Y1 is positively formed on the medium 12. The control portion 100 performs the first curl forming operation in Step S15 by moving the pair of medium support portions 37 from the retracted position in a direction of narrowing the interval in the width direction X. In the example illustrated in FIG. 25, the medium support portion 37 functions as the first curl forming mechanism 81 as an example of the first deformation forming portion that forms the curl C1 extending in the first direction Y1 on the medium 12.

Figure 26:
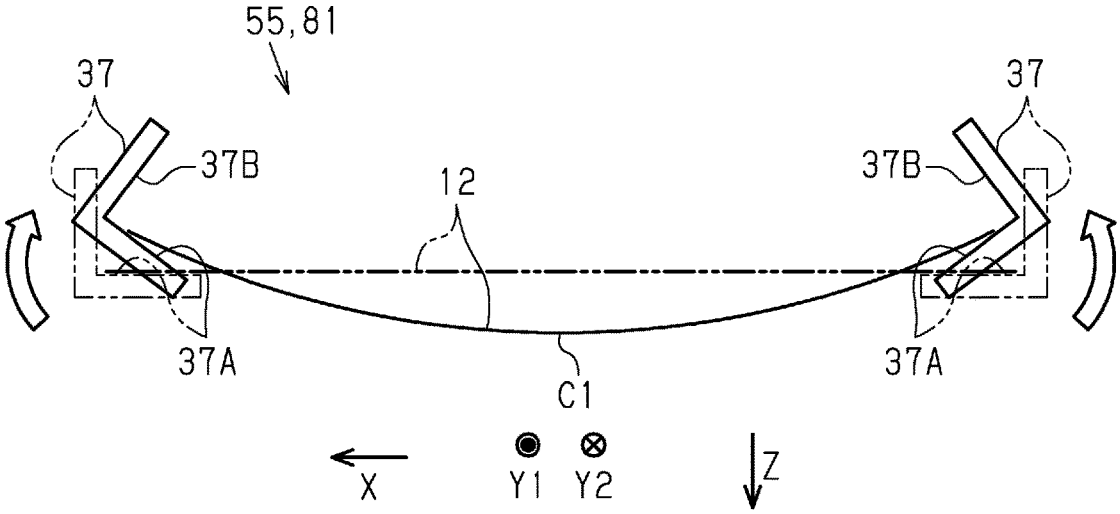
FIG. 26 is a schematic front view illustrating an example of the first curl forming mechanism by rotating the pair of medium support portions, as viewed from the direction along the first direction.
Figure 27:
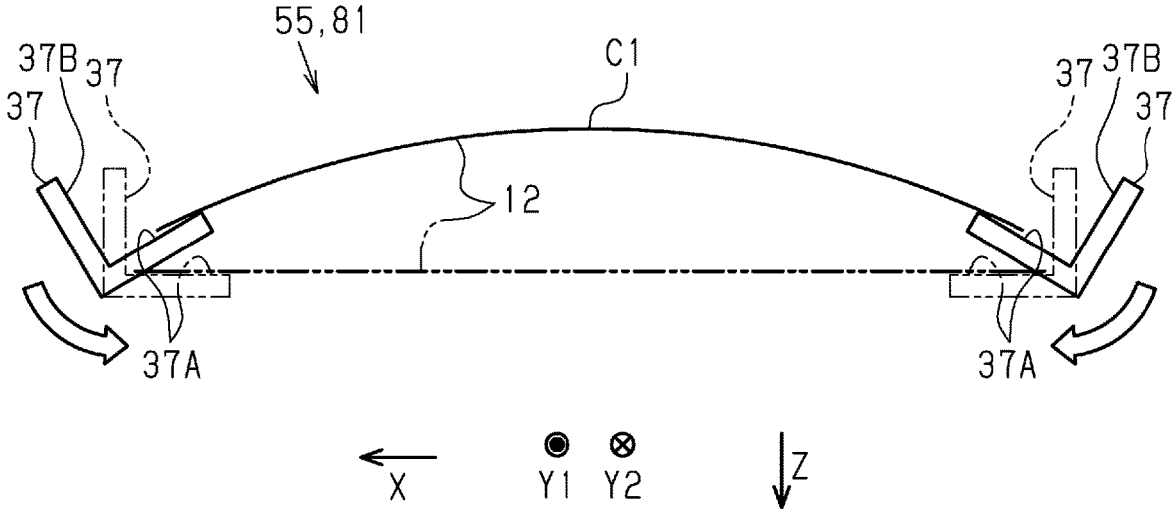
FIG. 27 is a schematic front view illustrating an example of the first curl forming mechanism by rotating the pair of medium support portions, as viewed from the first direction.

In addition, as illustrated in FIGS. 26 and 27, the pair of medium support portions 37 is provided on both sides in the width direction and is configured to be rotatable around an axis along the first direction Y1. By rotating the pair of medium support portions 37 around the axis, the curl C1 extending in the first direction Y1 is forcibly generated as a deformation with tension extending in the first direction Y1 with respect to the medium 12 on the intermediate stacker 32 (refer to FIGS. 2 and 4). That is, as illustrated in FIG. 26, the pair of medium support portions 37 is rotated from the support position illustrated by the two-dot chain line in the same drawing in the direction illustrated by the white arrow in the same drawing around the axis along the first direction Y1, and both end portions of the medium 12 in the width direction X are inclined to an angle indicated by a solid line in the same drawing. Therefore, the downwardly protruded curl C1 extending in the first direction Y1 is positively formed on the medium 12. The control portion 100 performs the first curl forming operation in step S15 by rotating the pair of medium support portions 37. In the example illustrated in FIG. 26, the medium support portion 37 functions as the first curl forming mechanism 81 as an example of the first deformation forming portion that forms the curl C1 extending in the first direction Y1 on the medium 12.

In addition, as illustrated in FIG. 27, the pair of medium support portions 37 is rotated from the support position illustrated by the two-dot chain line in the same drawing in the direction illustrated by the white arrow in the same drawing so as to lift the support portions of the medium 12 around the axis along the first direction Y1, and the pair of medium support portions 37 is lifted to the angle illustrated by a solid line in the same drawing. Therefore, an upwardly protruded curl C1 extending in the first direction Y1 is positively formed on the medium 12. The control portion 100 performs the first curl forming operation in step S15 by rotating the pair of medium support portions 37. In the example illustrated in FIG. 27, the medium support portion 37 functions as the first curl forming mechanism 81 as an example of the first deformation forming portion that forms the curl C1 extending in the first direction Y1 on the medium 12. The configuration for rotating the pair of medium support portions 37 includes a configuration in which the pair of medium support portions 37 is rotatably supported and the rotation shaft (all are not illustrated) is directly rotated by the power of the actuator, or the power of the actuator is transmitted to the pair of medium support portions 37 through a cam, link or gear train (not illustrated) to rotate the pair of medium support portions 37.

Figure 28:
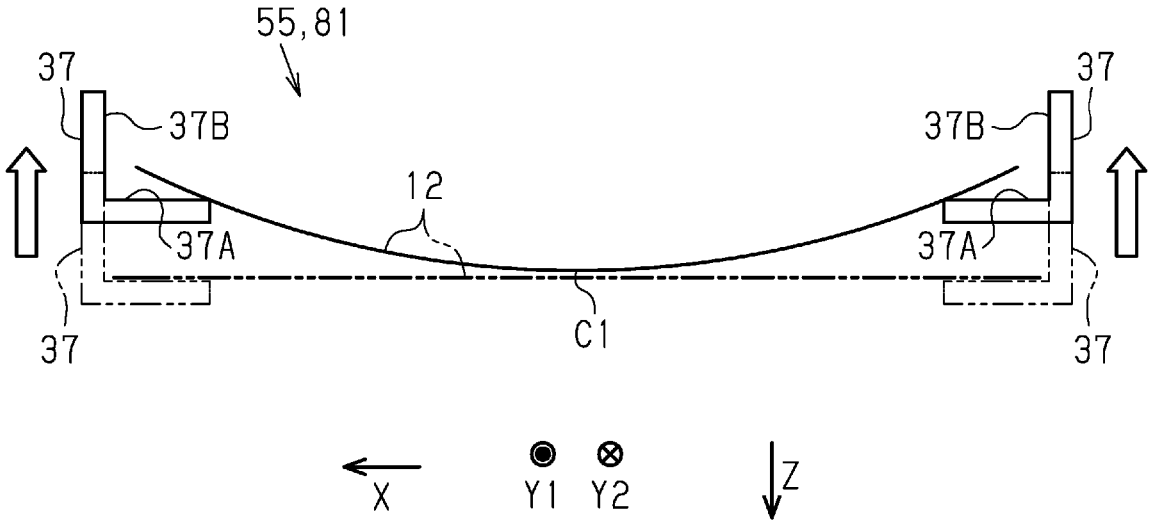
FIG. 28 is a schematic front view illustrating an example of the first curl forming mechanism by moving the pair of medium support portions up and down, as viewed from the direction along the first direction.

Furthermore, as illustrated in FIG. 28, the medium support portion 37 is configured to be movable up and down. The curl C1 extending in the first direction Y1 is forcibly generated as a deformation with tension extending in the width direction X with respect to the medium 12 on the intermediate stacker 32 (refer to FIGS. 2 and 4) by moving the medium support portion 37 up and down. That is, as illustrated in FIG. 28, by lifting the pair of medium support portions 37 from the support position illustrated by the two-dot chain line in the same drawing, the both end portions in the width direction X of the medium 12 are lifted as indicated by solid lines in the same drawing, and by hanging down the center portion of the medium 12 under its own weight, the downwardly protruded curl C1 extending in the first direction Y1 is positively formed on the medium 12. The control portion 100 performs the first curl forming operation in step S15 by moving the pair of medium support portions 37 up and down. In the example illustrated in FIG. 28, the medium support portion 37 functions as the first curl forming mechanism 81 as an example of the first deformation forming portion that positively forms the curl C1 extending in the first direction Y1 on the medium 12.

Figure 29:
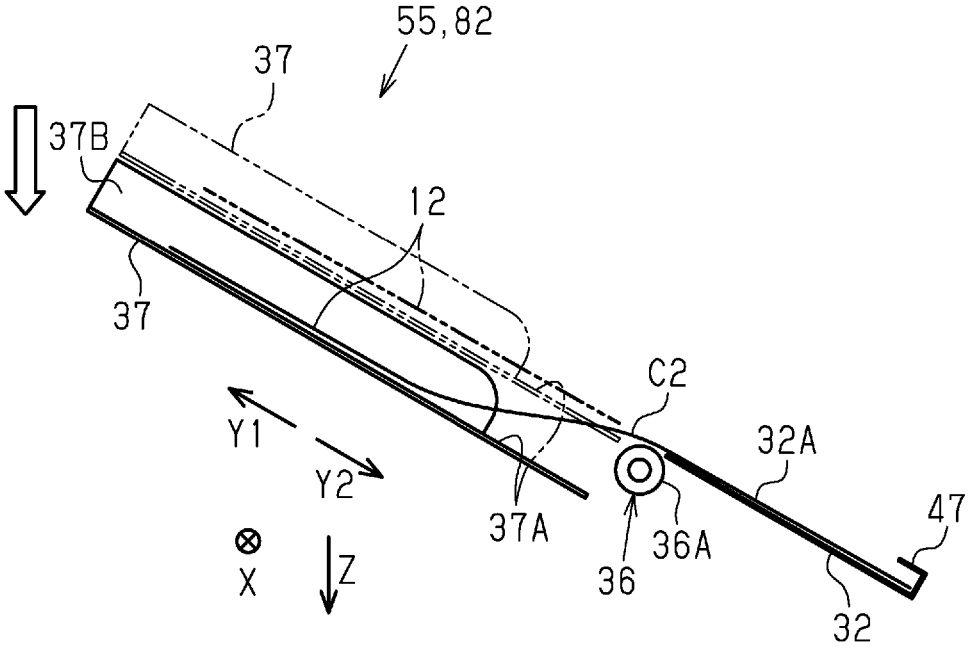
FIG. 29 is a schematic side view illustrating an example of the second curl forming mechanism by moving the pair of medium support portions up and down.

In addition, as illustrated in FIG. 29, the medium support portion 37 is configured to be movable up and down. The curl C2 extending in the width direction X is forcibly generated as a deformation with tension extending in the width direction X with respect to the medium 12 on the intermediate stacker 32 (refer to FIGS. 2 and 4) by moving the medium support portion 37 up and down. That is, as illustrated in FIG. 29, the pair of medium support portions 37 is lowered from the support position illustrated by the two-dot chain line in the same drawing in the direction illustrated by the white arrow in the same drawing, and a downstream portion of the medium 12 in the first direction Y1 is moved below the virtual surface obtained by extending the stacking surface 32A in the first direction Y1. As a result, the medium 12 hangs down from the downstream end in the first direction Y1 of the intermediate stacker 32 with its own weight, so that the curl C2 extending in the width direction X is positively formed. The control portion 100 performs the second curl forming operation in step S18 by lowering the medium support portion 37 from the support position. In the example illustrated in FIG. 29, the medium support portion 37 functions as the second curl forming mechanism 82 as an example of a second deformation forming portion that positively forms the curl C2 extending in the width direction X on the medium 12. In addition, in the configuration in which the medium support portion 37 is moved up and down, a configuration is desirable in which the curl forming operation is performed by lowering the support surface 37A of the medium support portion 37 below the virtual surface obtained by extending the stacking surface 32A of the intermediate stacker 32 in the first direction Y1, when the medium 12 is received on the intermediate stacker 32. For example, when the support surface 37A of the medium support portion 37 is configured to rise above the virtual surface, it is necessary to move the medium support portion 37 to the support position each time during the discharge operation or when receiving the next medium 12. On the other hand, when the support surface 37A of the medium support portion 37 is configured to be lowered below the virtual surface, even if the medium support portion 37 is not moved to the support position each time, the curl C2 extending in the width direction X can be forcibly generated with respect to the medium 12 received on the intermediate stacker 32.

The configuration for moving the pair of medium support portions 37 up and down includes a configuration in which the pair of medium support portions 37 is moved up and down by supporting the pair of medium support portions 37 so as to be movable up and down and transmitting the power of the actuator to the pair of medium support portions through a power transmission mechanism (not illustrated) such as a rack and pinion mechanism or a rotating cam mechanism. In FIGS. 24 to 28, the first curl forming operation may be performed by using any one of the movement of the pair of medium support portions 37 in the width direction X, the rotation of the pair of medium support portions 37 around the axis along the first direction Y1, and the vertical movement of the pair of medium support portions 37, and the protrusion of the first rib 83 in combination. In addition, In FIG. 29, the second curl forming operation may be performed by using the vertical movement of the pair of medium support portions 37 and the protrusion of the second rib 84 in combination.

In addition, the control portion 100 can also control the amount of forced deformation of the medium 12 in the first direction Y1 according to the protrusion amount of the first rib 83 and the amount of forced deformation of the medium 12 in the width direction X according to the protrusion amount of the second rib 84 with reference to the first reference data TD1 illustrated in FIG. 14. The first reference data TD1 illustrated in FIG. 14 is referred to by the control portion 100, in order to determine whether the amount of forced deformation of the medium 12 in the first direction Y1 according to the protrusion amount of the first rib 83 and the amount of forced deformation of the medium 12 in the width direction X according to the protrusion amount of the second rib 84 are set to a predetermined amount or less than a predetermined amount based on threshold values set for various condition items. The condition items include printing surface, printing area, printing duty, medium size, medium type, medium thickness, fiber direction, and curl amount. Here, each value of the printing surface, medium size, and medium type is acquired from the printing condition information in the print data PD. The amount of liquid on the both sides in double-sided printing, each value of the print area, and the print duty are acquired by the control portion 100 analyzing the image data in the print data PD. Here, the print duty is a value (%) represented by assuming that an average ejection amount indicating a liquid discharge amount per unit area when the print head 25 ejects liquid onto the medium 12 is 100% as a maximum ejection amount. The ejection control of the print head 25 is performed by duty control, and the average ejection amount ejected per unit area of the medium 12 corresponds to a value (%) converted into a duty value.

In addition, the medium thickness is acquired based on the detection value of the first detection portion 111. The fiber direction is acquired based on the detection value of the second detection portion 112. Furthermore, the curl amount is acquired based on the detection value of the third detection portion 113. When the medium 12 is a sheet, the fiber of the sheet is determined in one direction of a base sheet such as a roll sheet generated in the sheet manufacturing process, and the direction in which the roll sheet is cut differs depending on the medium size. Therefore, one of the longitudinal direction and the short direction of the quadrangular medium 12 is the fiber direction, and which direction is the fiber direction depends on the medium size and the like.

The first reference data TD1 is set with a threshold value that defines the ease of occurrence of curl of the printed medium 12 illustrated in FIG. 14 for each of a plurality of condition items. For each region specified by the threshold value for each condition item, the ease of occurrence of curl in the first direction Y1 and the ease of occurrence of curl in the width direction X on the printed medium 12 are different from each other. The amount of forced deformation in the first direction Y1 is determined by the protrusion amount of the first rib 83, and under the condition where the curl is likely to occur, a predetermined amount of forced deformation in the first direction Y1 determined by the protrusion amount of the first rib 83 is required. Under the condition that the curl is difficult to occur, the amount of forced deformation in the first direction Y1 determined by the protrusion amount of the first rib 83 is allowed even if the amount is less than a predetermined amount. In addition, the amount of forced deformation in the width direction X is determined by the protrusion amount of the second rib 84, and under the condition where the curl is likely to occur, a predetermined amount of forced deformation in the width direction X determined by the protrusion amount of the second rib 84 is required. Under the condition that the curl is difficult to occur, the amount of forced deformation in the width direction X determined by the protrusion amount of the second rib 84 is allowed even if the amount is less than a predetermined amount.

In the first reference data TD1 illustrated in FIG. 14, it can be referred to whether a predetermined amount is required or less than a predetermined amount is allowed for each of the amount of forced deformation in the first direction Y1 and the amount of forced deformation in the width direction X. "1" of the predetermined amount and less than a predetermined amount indicates "allowed" in which the corresponding amount of forced deformation is allowed, and "0" indicates "prohibited" not allowed.

The curl of the medium 12 due to the water contained in the liquid ejected during printing changes according to the values of various condition items in FIG. 14, and the degree of curl generated on the medium 12 due to the liquid adhering to the medium 12 varies depending on whether the value of various conditions takes two or three regions with the threshold as a boundary. When the curl amount generated on the medium 12 is large, a predetermined amount of forced deformation is necessarily required, and when the curl amount is small, the amount of forced deformation is not necessarily a predetermined amount, and may be less than a predetermined amount.

Therefore, under the condition that the curl amount due to the liquid of the medium 12 is large, and the amount of forced deformation is not less than a predetermined amount and is necessary for the predetermined amount, the prohibition "0" is set less than a predetermined amount in FIG. 14. That is, when the predetermined amount is "1" and less than a predetermined amount is "0", the amount less than a predetermined amount is prohibited, and thus the predetermined amount is required for the amount of forced deformation. On the other hand, under the condition that the curl amount due to the liquid of the medium 12 is small and the amount of forced deformation is less than a predetermined amount, the allowable "1" is set for less than a predetermined amount in FIG. 14. That is, when the predetermined amount is "1" and less than a predetermined amount is "1", the amount of forced deformation is allowed even if the amount is less than a predetermined amount.

Therefore, when the control portion 100 controls the protrusion and retraction of the ribs 83 and 84 with reference to the first reference data TD1 illustrated in FIG. 14, the following two types of control methods can be selected. One is a control method in which the protrusion amount of the ribs 83 and 84 is variable according to the value of the condition by setting the amount of forced deformation to a "less than a predetermined amount" when less than a predetermined amount is allowable "1" for the amount of forced deformation, and the amount of forced deformation to a "predetermined amount" when less than a predetermined amount is prohibited "0". The other is a method of controlling determining whether or not the ribs 83 and 84 are protruded according to the value of the condition by setting the amount of forced deformation to "0" when less than a predetermined amount includes "0 (zero)" and less than a predetermined amount is allowable "1" for the amount of forced deformation, and the amount of forced deformation to a "predetermined amount" when less than a predetermined amount is prohibited "0".

Next, the relationship among the condition items, the threshold value, and the amount of forced deformation will be described with reference to FIG. 14.

For example, when the condition item "printing surface" is "single side", since single side as the printing surface absorbs moisture in the liquid and extends, the medium 12 tends to curl easily. Therefore, both the amount of forced deformation in the first direction Y1 and the amount of forced deformation in the width direction X require to be a predetermined amount. In addition, in the case of "double sides, when the amount of liquid on the lower surface is large, the curl is likely to occur due to the lower surface absorbing the moisture of the liquid and extending. Therefore, both the first direction Y1 and the width direction X require a predetermined amount of forced deformation. Even in the case of "double sides", when the amount of liquid on the upper surface is large, the upper surface absorbs the moisture of the liquid and is likely to curl, but the curl is reduced by the weight of the medium. Therefore, as a result, the curl amount is reduced, so that the amount of forced deformation in both the first direction Y1 and the width direction X is allowed even if the amount is less than a predetermined amount.

In addition, the medium 12 tends to curl easily as the ratio of the printing area increases. When the printing area is a % or more, a predetermined amount of forced deformation is required in both the first direction Y1 and the width direction X. On the other hand, when the printing area is less than a %, the amount of forced deformation in both the first direction Y1 and the width direction X is allowed even if the amount is less than a predetermined amount. For example, the control portion 100 makes a second protrusion amount of the ribs 83 and 84 when the ratio of the printing area of the medium 12 is a second ratio smaller than a first ratio, smaller than a first protrusion amount of the ribs 83 and 84 when the ratio is the first ratio.

As the print duty is larger, the amount of liquid per unit area of the medium 12 is larger, so that the medium 12 tends to curl easily. When the print duty is b % or greater, the amount of forced deformation requires to be a predetermined amount in both the first direction Y1 and the width direction X. On the other hand, when the print duty is less than b %, the amount of forced deformation in both the first direction Y1 and the width direction X is allowed even if the amount is less than a predetermined amount. For example, the control portion 100 makes the second protrusion amount of the ribs 83 and 84 when the average liquid ejection amount per area to the medium 12 is a second ejection amount smaller than a first ejection amount, smaller than the first protrusion amount of the ribs 83 and 84 when the amount is the first ejection amount.

In addition, since the weight of the medium 12 increases as the medium size increases, the medium 12 tends to hardly curl. When the medium size exceeds A4 size, the amount of forced deformation in both the first direction Y1 and the width direction X is allowed even if the amount is less than a predetermined amount. On the other hand, when the medium size is A4 size or smaller, a predetermined amount of forced deformation is required in both the first direction Y1 and the width direction X. For example, the control portion 100 makes the first protrusion amount of the ribs 83 and 84 when the medium 12 has a first size larger than a second size, smaller than the second protrusion amount of the ribs 83 and 84 when the medium 12 has the second size.

In addition, the medium 12 tends to curl easily as the medium type is a material that easily absorbs liquid. When the medium type is a plain paper, a predetermined amount of forced deformation is required in both the first direction Y1 and the width direction X. On the other hand, when the medium type is other than the plain paper, the amount of forced deformation in both the first direction Y1 and the width direction X is allowed even if the amount is less than a predetermined amount.

Furthermore, the thinner the medium thickness, the higher a liquid absorption ratio, which is the liquid absorption amount per unit volume of medium 12, when the liquid ejection amount is the same. Therefore, the medium 12 tends to curl easily. When the medium thickness is t1 mm or more, the amount of forced deformation in both the first direction Y1 and the width direction X is allowed even if the amount is less than a predetermined amount. On the other hand, when the medium thickness is less than t1 mm, the amount of forced deformation requires to be a predetermined amount in both the first direction Y1 and the width direction X. For example, the control portion 100 makes the second protrusion amount of the ribs 83 and 84 when the medium 12 has a second media thickness greater than a first media thickness, smaller than the first protrusion amount of the ribs 83 and 84 when the medium 12 has the first medium thickness.

In addition, since the direction where the paper fiber absorbs the liquid and extends is a direction along the fiber direction in the medium 12, the medium 12 tends to curl along the fiber direction. When the fiber direction of the medium 12 is the longitudinal direction, the amount of forced deformation in the first direction Y1, which is the longitudinal direction, requires to be a predetermined amount. The amount of forced deformation in the width direction X, which is the short direction, is allowed even if the amount is less than a predetermined amount. On the other hand, when the fiber direction of the medium 12 is the short direction, the amount of forced deformation in the first direction Y1, which is the longitudinal direction, is allowed even if the amount is less than a predetermined amount. A predetermined amount of forced deformation in the width direction X, which is the short direction, is required. For example, the control portion 100 makes the second protrusion amount of the first rib 83 when the fiber direction of the medium 12 is in the width direction X, smaller than the first protrusion amount of the first rib 83 when the fiber direction is in the first direction Y1. In addition, the control portion 100 makes the second protrusion amount of the second rib 84 when the fiber direction of the medium 12 is in the first direction Y1, smaller than the first protrusion amount of the second rib 84 when the fiber direction is in the width direction X.

In addition, the greater the amount of curl of the medium 12, the greater the amount of forced deformation of the medium 12. When the curl amount of the medium 12 is a predetermined value or larger, the amount of forced deformation requires to be a predetermined amount in both the first direction Y1 and the width direction X. On the other hand, when the curl amount of the medium 12 is less than the predetermined value, the amount of forced deformation in both the first direction Y1 and the width direction X is allowed even if the amount is less than a predetermined amount. For example, the control portion 100 makes the second protrusion amount of the ribs 83 and 84 when the curl amount of the medium 12 is the second curl amount smaller than the first curl amount, smaller than the first protrusion amount of the ribs 83 and 84 when the curl amount is the first curl amount.

The control portion 100 refers to the first reference data TD1 to determine the protrusion amount of the first rib 83 and the second rib 84. In this case, the control portion 100 may select one condition item from a plurality of condition items, and may determine the protrusion amounts of the first rib 83 and the second rib 84 with reference to the first reference data TD1 based on the value of the selected one condition. In addition, the control portion 100 may select a portion of two or more of the plurality of condition items, or may select all the condition items. When the plurality of condition items are selected, if the number of condition items with "1" being less than a predetermined amount is a predetermined number or greater, control may be performed so that it is less than the predetermined amount, and if the number of condition items is less than the predetermined number, the control may be performed so that it is a predetermined amount. In addition, when the plurality of condition items are used in combination, an evaluation value is obtained by accumulating a standard value obtained by standardizing the condition value for each condition item and a contribution rate for each condition item, and the evaluation value may be compared with a threshold value to determine whether the protrusion amount of the ribs 83 and 84 is a predetermined amount or less than the predetermined amount.

The second reference data TD2 illustrated in FIG. 15 is data that the control portion 100 refers to when the medium support portion 37 is used as the first curl forming mechanism 81 and the second curl forming mechanism 82. The control portion 100 determines whether or not to perform the width movement or rotation of the medium support portion 37 constituting the first curl forming mechanism 81 by referring to the second reference data TD2 based on the value of the condition acquired for each condition item, and determines whether or not to perform the vertical movement of the medium support portion 37 constituting the second curl forming mechanism 82. For example, when the printing surface is a single side, in order to forcibly form the curl C1 extending in the first direction Y1, the width movement or rotation (FIGS. 24 to 27) of the medium support portion 37 is performed, and in order to forcibly form the curl C2 extending in the width direction X, the vertical movement (refer to FIG. 29) of the medium support portion 37 is performed. In addition, when the printing area is less than a %, the width movement or rotation of the medium support portion 37 is not performed, and the vertical movement of the medium support portion 37 is not performed.

The control portion 100 refers to the second reference data TD2, and determines whether or not the width movement or rotation of the medium support portion 37 is performed, and whether or not the vertical movement of the medium support portion 37 is performed. In this case, when the control portion 100 determines whether or not to perform the width movement or rotation of the medium support portion 37 and whether or not to perform the vertical movement of the medium support portion 37, by referring to the second reference data TD2 based on the value acquired for each condition item, only one condition item may be selected, a portion of the condition items may be selected, or all condition items may be selected.

Furthermore, both the first rib 83 and the medium support portion 37 may be used as the first curl forming mechanism 81, and both the second rib 84 and the medium support portion 37 may be used as the second curl forming mechanism 82. In addition, when the curl forming mechanisms 81 and 82 include the ribs 83 and 84 provided on the intermediate stacker 32, and the medium support portion 37, any of the following combinations may be used. For example, a combination of the first rib 83 provided on the intermediate stacker 32 and forming the curl C1 extending in the first direction Y1 on the medium 12, and the vertical movement of the medium support portion 37 forming the curl C2 extending in the width direction X on the medium 12 may be used. In addition, a combination of the movement in the width direction or rotation of the medium support portion 37 forming the curl C1 extending in the first direction Y1 on the medium 12, and the second rib 84 provided on the intermediate stacker 32 and forming the curl C2 extending in the width direction X on the medium 12 may be used. In addition, basically, the first rib 83 and the second rib 84 provided on the intermediate stacker 32 are used, and the medium support portion 37 may or may not be used supplementarily.

According to the above embodiment, the following effects can be obtained.

(1) The medium stacking device 31 is provided with the intermediate stacker 32 that receives the medium 12 treated and discharged by the reversing treatment portion 200, and the first alignment member 38 that is movable between the first position P1 performing the alignment operation on the medium 12 on the intermediate stacker 32, and the second position P2 that is separated further from the leading edge 12*f* of the medium 12 than is the first position P1. Furthermore, the medium stacking device 31 is provided with the discharge stacker 35 that stacks the medium 12 transported from the intermediate stacker 32. The medium 12 transported from the intermediate stacker 32 is stacked on the discharge stacker 35 after the leading edge 12*f* contacts the first alignment member 38 at the second position P2. Therefore, the medium 12 discharged to the discharge stacker 35 can be aligned using the first alignment member 38 that aligns the medium 12 on the intermediate stacker 32.

(2) When the medium 12 is discharged from the reversing treatment portion 200, the first alignment member 38 is positioned at the third position P3 that is a position between the first position P1 and the second position P2. Therefore, the drop position of the medium 12 treated by the reversing treatment portion 200 can be defined to some extent.

(3) The intermediate stacker 32 has the medium abutment portion 47 that aligns the medium 12 by contacting the trailing edge 12*r* of the medium 12. The first alignment member 38 applies a force to the medium 12 on the intermediate stacker 32 in a direction toward the medium abutment portion 47 at the first position P1. Therefore, the alignment of the medium 12 on the intermediate stacker 32 can be performed.

(4) The medium stacking device 31 includes the paddles 45 and 46 as feeding portions that apply a force to the medium 12 on the intermediate stacker 32 in a direction toward the medium abutment portion 47. Therefore, the alignment of the medium 12 on the intermediate stacker 32 can be enhanced.

(5) The medium stacking device 31 includes the discharge mechanism 36 that discharges the medium 12 on the intermediate stacker 32 in a direction toward the stacking portion. Therefore, the medium 12 can be discharged from the intermediate stacker 32 to the discharge stacker 35.

(6) The medium stacking device 31 is further provided with the medium support portion 37 that temporarily supports the medium 12 transported from the intermediate stacker 32 vertically above the discharge stacker 35. The medium 12 supported by the medium support portion 37 is stacked on the discharge stacker 35 after the leading edge 12*f* contacts the first alignment member 38 at the second position P2. Therefore, the medium 12 discharged to the discharge stacker 35 can be aligned by defining the drop position of the medium 12 to some extent when discharging the medium 12 to the discharge stacker 35. For example, if the medium support portion 37 is not provided, when the leading edge portion of the medium 12 hangs down and the hanged leading edge portion comes into contact with the stacking surface 35A of the discharge stacker 35, although there is a possibility that the medium 12 may be wound inward and folded, this type of folding can be suppressed.

(7) The post-treatment apparatus 14 is provided with the medium stacking device 31 and the post-treatment mechanism 33 that performs the post-treatment on the medium 12 on the intermediate stacker 32. Therefore, the positional accuracy of post-treatment can be enhanced.

(8) The method of controlling the medium stacking device is provided with (A) receiving the medium 12 treated and discharged by the reversing treatment portion 200 on the intermediate stacker 32, and (B) moving the contact portion to the first position to align the medium 12 on the intermediate stacker 32 in the first direction Y1. Furthermore, the method of controlling the medium stacking device is provided with (C) moving the first alignment member 38 to the second position P2 separated further from the leading edge 12*f* of the medium 12 than is the first position P1, and (D) bringing the leading edge 12*f* of the medium 12 transported from the intermediate stacker 32 into contact with the first alignment member 38 at the second position P2. The method of controlling the medium stacking device is provided with (E) stacking the medium 12 brought into contact with the first alignment member 38 at the second position P2 by the discharge stacker 35. Therefore, it is possible to align the medium 12 discharged to the stacking portion by using the contact portion that aligns the medium 12 on the intermediate stacker 32.

(9) The method of controlling the medium stacking device 31 is further provided with (F) aligning in the width direction X, after aligning the medium 12 on the intermediate stacker 32 in the first direction Y1. According to this method, the alignment of the medium 12 on the intermediate stacker 32 can be enhanced.

(10) The method of controlling the medium stacking device 31 is further provided with (G) performing the post-treatment on the medium 12 after aligning the medium 12 on the intermediate stacker 32. According to this method, the post-treatment with high positional accuracy can be performed on the medium 12 on the intermediate stacker 32.

(11) The medium stacking device 31 is provided with the first curl forming mechanism 81 forcibly generating the curl C1 extending in the first direction Y1 with respect to the medium 12 on the intermediate stacker 32, and the second curl forming mechanism 82 forcibly generating the curl C2 extending in the width direction X intersecting the first direction Y1 with respect to the medium 12 on the intermediate stacker 32. In addition, the medium stacking device 31 is provided with the first alignment mechanism 51 that aligns the medium 12 on the intermediate stacker 32 in the first direction Y1, and the second alignment mechanism 52 that aligns the medium 12 on the intermediate stacker 32 in the width direction X. The medium stacking device 31 includes the first alignment mode in which alignment is performed by the first alignment mechanism 51 in a state where the curl C1 extending in the first direction Y1 is generated on the medium 12 by the first curl formation mechanism 81, and the second alignment mode in which alignment is performed by the second alignment mechanism 52 in a state where the curl C2 extending in the width direction X is generated on the medium 12 by the second curl forming mechanism 82. Therefore, the curls C1 and C2 extending in the direction intersecting the alignment direction can be forcibly generated with respect to the two directions in which the medium 12 is aligned, so that the alignment of the medium 12 can be enhanced.

(12) The first curl forming mechanism 81 includes the first rib 83 extending in a direction along the first direction Y1. The first rib 83 is movable between the protruded state that protrudes from the intermediate stacker 32 by a predetermined amount and the retracted state where the protrusion amount from the intermediate stacker 32 is less than a predetermined amount. Therefore, the curl C1 extending in the first direction Y1 can be generated on the medium 12 on the intermediate stacker 32 when necessary.

(13) The second curl forming mechanism 82 includes the second rib 84 extending in the direction along the width direction X. The second rib 84 is movable between the protruded state that protrudes from the intermediate stacker 32 by a predetermined amount and the retracted state where the protrusion amount from the intermediate stacker 32 is less than a predetermined amount. Therefore, the curl C2 extending in the width direction X can be generated on the medium 12 on the intermediate stacker 32 when necessary.

(14) The medium stacking device 31 is further provided with the medium support portion 37 that supports the leading edge portion of the medium 12 on the intermediate stacker 32. The first curl forming mechanism 81 includes the medium support portion 37. The medium support portions 37 are provided on both sides in the width direction X and are movable in the width direction X. By moving in the width direction X, the curl C1 extending in the first direction Y1 is forcibly generated with respect to the medium 12 on the intermediate stacker 32. Therefore, the curl C1 extending in the first direction Y1 can be generated on the medium 12 on the intermediate stacker 32 when necessary.

(15) The medium stacking device 31 is further provided with the medium support portion 37 that supports the leading edge portion of the medium 12 on the intermediate stacker 32. The first curl forming mechanism 81 includes the medium support portion 37. The medium support portions 37 are provided on both sides in the width direction X, are rotatable around the axis along the first direction Y1, and forcibly generates the curl C1 extending in the first direction Y1 with respect to the medium 12 on the intermediate stacker 32 by rotating around the axis. Therefore, the curl C1 extending in the first direction Y1 can be generated on the medium 12 on the intermediate stacker 32 when necessary.

(16) The medium stacking device 31 is further provided with the medium support portion 37 that supports the leading edge portion of the medium 12 on the intermediate stacker 32. The second curl forming mechanism 82 includes the medium support portion 37, and the medium support portion 37 can move up and down. The curl C2 extending in the width direction X is forcibly generated with respect to the medium 12 on the intermediate stacker 32 by moving up and down. Therefore, the curl C2 extending in the width direction X can be generated on the medium 12 on the intermediate stacker 32 when necessary.

(17) The medium stacking device 31 includes the intermediate stacker 32, and the first rib 83 extending in a direction along the first direction Y1 with respect to the medium 12 on the intermediate stacker 32, and that is movable between the protruded state protruding a predetermined amount from the intermediate stacker 32 and the retracted state in which the protruding amount from the intermediate stacker 32 is less than a predetermined amount. In addition, the medium stacking device 31 includes the second rib 84 extending in a direction along the width direction X intersecting the first direction Y1 with respect to the medium 12 on the intermediate stacker 32, and that is movable between the protruded state protruding a predetermined amount from the intermediate stacker 32 and the retracted state in which the protruding amount from the intermediate stacker 32 is less than a predetermined amount. In addition, the medium stacking device 31 is provided with the first alignment mechanism 51 that aligns the medium 12 on the intermediate stacker 32 in the first direction Y1, and the second alignment mechanism 52 that aligns the medium 12 on the intermediate stacker 32 in the width direction X. The medium stacking device 31 has the first alignment mode in which the first rib 83 is in a protruded state and is aligned by the first alignment mechanism 51, and the second alignment mode in which the second rib 84 is in a protruded state and is aligned by the second alignment mechanism 52. Therefore, the curls C1 and C2 extending in the direction intersecting the alignment direction can be forcibly generated with respect to the two directions in which the medium 12 is aligned, so that the alignment of the medium 12 can be enhanced.

(18) The first rib 83 and the second rib 84 are provided in a state of intersecting each other on the intermediate stacker 32. Therefore, two types of ribs 83 and 84 can be provided in a small space.

(19) The post-treatment apparatus 14 is provided with the medium stacking device 31, and the post-treatment mechanism 33 that performs the post-treatment on the medium 12 on the intermediate stacker 32. Therefore, the positional accuracy of post-treatment can be enhanced.

(20) The medium stacking device 31 is provided with the intermediate stacker 32, the first curl forming mechanism 81, the second curl forming mechanism 82, the first alignment mechanism 51, and the second alignment mechanism 52. A medium alignment method of the medium stacking device 31 is provided with (A) receiving the medium 12 treated and discharged by the reversing treatment portion 200 and transported in the first transport direction Y0 on the intermediate stacker 32, and (B) aligning by the first alignment mechanism 51 in a state where the curl C1 extending in the first direction Y1 is generated on the medium 12 on the intermediate stacker 32 by the first curl forming mechanism 81. Furthermore, the medium alignment method of the medium stacking device 31 is provided with (C) aligning by the second alignment mechanism 52 in a state where the curl C2 extending in the width direction X is generated on the medium 12 on the intermediate stacker 32 by the second curl forming mechanism 82. According to this medium alignment method, the curls C1 and C2 extending in the direction intersecting the alignment direction can be forcibly generated with respect to the two directions in which the medium 12 is aligned, so that the alignment of the medium 12 can be enhanced.

The above embodiments can also be changed into aspects as modification examples illustrated below. Furthermore, a combination of the above embodiment and the modification examples described below as appropriate can be used as a further modification example, and a combination of the following modification examples as appropriate can be used as a further modification example.

When aligning the medium 12 on the intermediate stacker 32, the curl forming mechanisms 81 and 82 may or may not be used in combination. In addition, the curl forming mechanisms 81 and 82 having the ribs 83 and 84 may not be provided.

In the above embodiment, although the first position P1 to the third position P3 are changed according to the size of the medium 12, and these may not be changed. For example, when the size of the medium 12 to be used is one type, it is not necessary to change the size. When the first alignment member 38 is used to increase the alignment accuracy only for the medium 12 of a specific size, the first position P1 to the third position P3 are determined as one according to the medium size.

The second position P2 and the third position P3 are determined by the positional relationship on the transport path between the nip position of the transport roller pair 19B and the nip position of the discharge mechanism 36. Therefore, depending on this positional relationship, the second position P2 may be located between the first position P1 and the third position P3.

The third position P3 may not be provided. For example, when the intermediate stacking portion receives the medium, the contact portion may be positioned at the second position P2. Alternatively, the contact portion may be positioned at a fourth position that is separated further from the leading edge 12*f* of the medium 12 than is the second position P2.

The configuration for guiding the medium 12 treated and discharged by the treatment portion to the intermediate stacker 32 is not limited to the configuration of the movable guide 42 and the first paddle 45. For example, an attraction transport belt that transports the medium while attracting the medium to the belt may be used. Examples of the attraction method of the attraction transport belt include negative pressure, static electricity, or the like. In this case, the attraction transport belt attracts the medium discharged in the first transport direction Y0 from the transport mechanism 30 to the upper position of the intermediate stacker 32, and transports the medium to the upper position of the intermediate stacker 32. Thereafter, the medium 12 may be forcibly separated from the belt by releasing the attraction or using a movable guide and dropped on the stacking surface 32A. In addition, after the medium attracted on the attraction transport belt is transported in the first transport direction Y0, switchback transport that transports the medium 12 in a second transport direction opposite to the first transport direction Y0 may be performed by reversing the movement direction of the belt. In the process of being transported in the second transport direction, the medium 12 may be separated from the attraction transport belt or the attraction may be released to drop the medium 12 onto the stacking surface 32A.

When the medium 12 on the intermediate stacker 32 is discharged in the direction of the discharge stacker 35, the driving of the discharge mechanism 36 may be started after the start of the movement of the first alignment member 38 which is an example of the contact portion from the first position P1 to the second position P2. The discharge mechanism 36 may be driven simultaneously with the start of the movement of the first alignment member 38 from the first position P1 to the second position P2.

The post-treatment may be applied not only to the media bundle 12B but also to a single medium 12.

The treatment portion is not limited to the printing treatment or the treatment of changing the posture of the medium, such as reversing the medium. That is, the treatment portion is not limited to the reversing treatment portion 200 of the intermediate apparatus 15 or the print head 25 that performs the printing treatment in the printing apparatus 13. For example, a treatment portion that performs a coating treatment on the medium 12, a treatment portion that performs a heat treatment on the medium 12, and a treatment portion that performs a photo-curing treatment on a photo-curable resin attached to the medium 12 may be used.

The transport mechanism 30 is not limited to the roller transport system that transports the medium 12 using one or a plurality of roller pairs. The transport mechanism 30 may be a belt transport system.

In the medium treatment system 11, the intermediate apparatus 15 may not be provided. That is, the medium treatment system 11 may be configured to include the printing apparatus 13 and the post-treatment apparatus 14. For example, the reversing treatment portion 200 of the intermediate apparatus 15 may be incorporated in the post-treatment apparatus 14. In this case, the post-treatment apparatus 14 reverses the medium 12 carried from the printing apparatus 13 inside, and thereafter receives the medium 12 on the intermediate stacker 32 to perform the post-treatment. For example, the reversing treatment portion 200 of the intermediate apparatus 15 may be incorporated in the printing apparatus 13. In this case, the post-treatment apparatus 14 causes the intermediate stacker 32 to receive the reversed medium 12 carried from the printing apparatus 13 and performs the post-treatment.

When the configuration of the medium treatment system 11 according to the above modification example is adopted, the medium treatment apparatus is not limited to the post-treatment apparatus 14 having the medium stacking device 31. That is, the medium treatment apparatus may be the post-treatment apparatus 14 including the reversing treatment portion 200 and the medium stacking device 31. In addition, the medium treatment apparatus may be the printing apparatus 13 including the medium stacking device 31 or the printing apparatus 13 including the reversing treatment portion 200 and the medium stacking device 31. In these cases, the printing apparatus 13 is preferably provided with the post-treatment mechanism 33.

The medium 12 is not limited to the sheet, and may be a film or sheet made of synthetic resin, cloth, nonwoven fabric, laminated sheet, or the like.

The printing apparatus 13 is not limited to a liquid ejection method such as an ink jet method, and may be a dot impact method or an electro photographic method. In addition, the printing apparatus 13 may be a textile printing apparatus. In addition, the printing apparatus 13 may be a multifunction machine having a scanner mechanism and a copy function in addition to the print function.

Hereinafter, the technical idea grasped from the above embodiment and the modified example will be described together with effects.

Idea 1

An intermediate stacking portion that receives a medium treated by a treatment portion, a contact portion configured to move between a first position for performing an alignment operation on the medium on the intermediate stacking portion, and a second position that is separated further from a leading edge of the medium than is the first position, and a stacking portion that stacks the medium transported from the intermediate stacking portion are included, and the medium transported from the intermediate stacking portion is stacked on the stacking portion after the leading edge contacts the contact portion positioned at the second position.

According to this configuration, the medium discharged to the stacking portion can be aligned by using the contact portion that aligns the medium on the intermediate stacking portion. Therefore, it is possible to enhance the alignment of the medium discharged to the stacking portion after the alignment.

Idea 2

In the medium stacking device according to [Idea 1], when the intermediate stacking portion receives the medium, the contact portion may be positioned at a third position that is a position between the first position and the second position. According to this configuration, the drop position of the medium treated by the treatment portion can be defined to some extent.

Idea 3

In the medium stacking device according to [Idea 1] or [Idea 2], the intermediate stacking portion may include a medium abutment portion that aligns the medium by contacting a trailing edge of the medium, and the contact portion may apply, at the first position, to the medium on the intermediate stacking portion, a force in a direction toward the medium abutment portion. According to this configuration, the medium on the intermediate stacking portion can be aligned.

Idea 4

The medium stacking device according to [Idea 3] may further include a feed portion that applies, to the medium on the intermediate stacking portion, a force in a direction toward the medium abutment portion. According to this configuration, the alignment of the medium on the intermediate stacking portion can be enhanced.

Idea 5

The medium stacking device according to any one of [Idea 1] to [Idea 4] may further include a discharge mechanism that discharges the medium on the intermediate stacking portion in a direction toward the stacking portion. According to this configuration, the medium can be discharged from the intermediate stacking portion to the stacking portion.

Idea 6

The medium stacking device according to any one of [Idea 1] to [Idea 5] may further include a medium support portion that is provided vertically above the stacking portion and temporarily supports the medium transported from the intermediate stacking portion, and the medium supported by the medium support portion may be stacked on the stacking portion after the leading edge contacts the contact portion positioned at the second position.

According to this configuration, the medium to be discharged to the stacking portion can be aligned by defining the drop position of the medium to some extent when discharging the medium to the stacking portion. For example, if the medium support portion is not provided, when the leading edge portion of the medium hangs down and the hanged leading edge portion comes into contact with the stacking surface, although there is a possibility that the medium may be wound inward and folded, this type of folding can be suppressed.

Idea 7

The medium treatment apparatus is provided with the medium stacking device according to any one of [Idea 1] to [Idea 6], and a post-treatment mechanism that performs a post-treatment on a medium on the intermediate stacking portion. According to this configuration, the positional accuracy of post-treatment can be enhanced.

Idea 8

A method of controlling a medium stacking device is provided with receiving a medium treated by a treatment portion on an intermediate stacking portion, moving a contact portion to a first position to align the medium on the intermediate stacking portion in a transport direction, moving the contact portion to a second position that is separated further from a leading edge of the medium than is the first position, bringing the leading edge of the medium transported from the intermediate stacking portion into contact with the contact portion positioned at the second position, and stacking, on a stacking portion, the medium brought into contact with the contact portion at the second position.

According to this method, it is possible to align the medium discharged to the stacking portion by using the contact portion that aligns the medium on the intermediate stacking portion.

Idea 9

The method of controlling a medium stacking device according to [Idea 8] may further include aligning the medium in a width direction intersecting the transport direction, after aligning the medium on the intermediate stacking portion in the transport direction. According to this method, the alignment of the medium on the intermediate stacking portion can be enhanced.

Idea 10

The method of controlling a medium stacking device according to [Idea 8] or [Idea 9] may further include performing a post-treatment on the medium after aligning the medium on the intermediate stacking portion. According to this method, the post-treatment with high positional accuracy can be performed on the medium on the intermediate stacking portion.

What is claimed is:

1. A medium stacking device comprising:

an intermediate stacking portion that receives a medium treated by a treatment portion;

a contact portion configured to move between a first position for performing an alignment operation on a leading edge of the medium on the intermediate stacking portion, and a second position that is separated further from the leading edge of the medium than is the first position; and a stacking portion that stacks the medium transported from the intermediate stacking portion, wherein the medium transported from the intermediate stacking portion is stacked on the stacking portion after the leading edge contacts the contact portion positioned at the second position.

2. The medium stacking device according to claim 1, wherein when the intermediate stacking portion receives the medium, the contact portion is positioned at a third position that is a position between the first position and the second position.

3. The medium stacking device according to claim 1, wherein the intermediate stacking portion includes a medium abutment portion that aligns the medium by contacting a trailing edge of the medium, and the contact portion applies, at the first position, to the medium on the intermediate stacking portion, a force in a direction toward the medium abutment portion.

4. The medium stacking device according to claim 3, further comprising:

a feed portion that applies, to the medium on the intermediate stacking portion, a force in a direction toward the medium abutment portion.

5. The medium stacking device according to claim 1, further comprising:

a discharge mechanism that discharges the medium on the intermediate stacking portion in a direction toward the stacking portion.

6. The medium stacking device according to claim 1, further comprising:

a medium support portion that is provided vertically above the stacking portion and temporarily supports the medium transported from the intermediate stacking portion, wherein the medium supported by the medium support portion is stacked on the stacking portion after the leading edge contacts the contact portion positioned at the second position.

7. A medium treatment apparatus comprising:

the medium stacking device according to claim 1; and a post-treatment mechanism that performs a post-treatment on a medium on the intermediate stacking portion.

8. A method of controlling a medium stacking device, comprising:

receiving a medium treated by a treatment portion on an intermediate stacking portion;

moving a contact portion to a first position to align the medium on the intermediate stacking portion in a transport direction;

moving the contact portion to a second position that is separated further from a leading edge of the medium than is the first position;

bringing the leading edge of the medium transported from the intermediate stacking portion into contact with the contact portion positioned at the second position; and stacking, on a stacking portion, the medium brought into contact with the contact portion at the second position.

9. The method of controlling a medium stacking device according to claim 8, further comprising:

aligning the medium in a width direction intersecting the transport direction, after aligning the medium on the intermediate stacking portion in the transport direction.

10. The method of controlling a medium stacking device according to claim 8, further comprising:

performing a post-treatment on the medium after aligning the medium on the intermediate stacking portion.

11. The medium stacking device according to claim 1, wherein the contact position reciprocates in a discharge direction where the medium is discharged toward the intermediate stacking portion.

12. A medium stacking device comprising:

an intermediate stacking portion that receives a medium treated by a treatment portion;

a contact portion configured to move between a first position for performing an alignment operation on the medium on the intermediate stacking portion, and a second position that is separated further from a leading edge of the medium than is the first position; and a stacking portion that stacks the medium transported from the intermediate stacking portion, wherein the leading edge of the medium transported from the intermediate stacking portion is brought into contact with the contact portion positioned at the second position after the contact portion has been moved to the first position to perform the alignment operation and has been moved from the first position to the second position, and wherein the medium brought into contact with the contact portion at the second position is stacked on the stacking portion after the leading edge contacts the contact portion.

* * * * *